US005559577A

United States Patent [19]

Miyazawa et al.

[11] Patent Number: 5,559,577

[45] Date of Patent: Sep. 24, 1996

[54] DEVICE FOR REPLENISHING SOLID PROCESSING AGENT USED IN A LIGHT-SENSITIVE MATERIAL PROCESSING APPARATUS

[75] Inventors: Yorikatsu Miyazawa; Hideo Ishii; Toshiyuki Ikariya; Hideo Kobayashi; Shigeharu Koboshi; Yutaka Takei; Haruo Hakamada, all of Tokyo, Japan

[73] Assignee: Konica Corporation, Tokyo, Japan

[21] Appl. No.: 387,114

[22] Filed: Feb. 10, 1995

[30] Foreign Application Priority Data

| | | | |
|---|---|---|---|
| Feb. 16, 1994 | [JP] | Japan | 019551 |
| Feb. 16, 1994 | [JP] | Japan | 019552 |
| Feb. 16, 1994 | [JP] | Japan | 041925 |

[51] Int. Cl.[6] ..... G03D 13/00; B65H 1/00

[52] U.S. Cl. ..... 354/297; 221/197; 221/287

[58] Field of Search ..... 354/324; 137/268; 221/97, 197, 231, 232, 263, 277, 287

[56] References Cited

U.S. PATENT DOCUMENTS

| | | | |
|---|---|---|---|
| 4,869,395 | 9/1989 | Rubbmark | 221/287 X |
| 4,889,260 | 12/1989 | Zeller | 221/197 |
| 5,318,061 | 6/1994 | Saito | 354/324 X |
| 5,351,103 | 9/1994 | Komatsu et al. | 354/324 |
| 5,378,588 | 1/1995 | Tsuchiya | 430/398 X |
| 5,400,105 | 3/1995 | Koboshi et al. | 354/324 |

FOREIGN PATENT DOCUMENTS

| | | |
|---|---|---|
| 0537788A3 | 4/1993 | European Pat. Off. . |
| 0581197A2 | 2/1994 | European Pat. Off. . |
| WO92/20013 | 12/1992 | WIPO . |

*Primary Examiner*—D. Rutledge

*Attorney, Agent, or Firm*—Frishauf, Holtz, Goodman, Langer & Chick

[57] ABSTRACT

In an apparatus for supplying a solid processing agent to a processing tank of a photographic material processing apparatus, there is provide a put-back mechanism for putting a solid processing agent back into an accommodation container when the accommodation container is moved from a operating position to a maintenance position on which the accommodation container can be replaced with a new one.

18 Claims, 35 Drawing Sheets

DEVICE FOR REPLENISHING SOLID PROCESSING AGENT USED IN A LIGHT-SENSITIVE MATERIAL PROCESSING APPARATUS

BACKGROUND OF THE INVENTION

The present invention relates to a device for replenishing solid processing agent used in a light-sensitive material processing apparatus, and particularly to a device for replenishing solid processing agent used in a light-sensitive material processing apparatus wherein prevention of erroneous operation in inserting and removing an accommodating container for solid processing agents and/or easy operation in inserting and removing an accommodating container are improved.

Light-sensitive materials are processed through the steps of developing, desilvering, washing and stabilizing, after exposure. This processing is carried out usually in an automatic processing apparatus wherein a replenisher-replenishing method is generally used to maintain the activeness of a processing solution in a processing tank.

In the case of the replenisher-replenishing method, it object is to dilute substances which have dissolved out of light-sensitive materials, to supplement an amount evaporated, and to replenish an amount consumed, and replenishment of replenishers usually results in discharge of a large amount of overflowed solution.

To process light-sensitive materials on a commercial basis, it is required to obtain stable and excellent processing performance with the smallest possible amount of processing solution for the purposes of reduction of cost and labor, decrease in burden of environmental pollution, miniaturization of a processing apparatus and enhancement of commodity value.

As a method to meet the requirements above, W092/20013 Publication (corresponding to U.S. Pat. No. 5,351,103) discloses a method wherein most components of processing agents are solidified to be solid processing agents which are supplied directly to a processing tank.

However, in the case of using solid processing agents, it is required that various solid processing agents are replenished into a predetermined processing tank correctly and easily. Therefore, it was found that prevention of erroneous operation for avoiding wrong insertion of a solid processing agent accommodating container and a technology for inserting and removing the accommodating container easily are necessary.

The present invention has been attained to solve at least one of the problems mentioned above, and its first object is to provide a device for replenishing solid processing agent used in a light-sensitive material processing apparatus wherein prevention of erroneous operation in inserting and removing an accommodating container for solid processing agents and/or easy operation in inserting and removing an accommodating container are improved.

A solid processing agent requires moisture-proof measures, and there is a fear that dust generated from the solid processing agent scatters and enters other processing tanks, causing deterioration of photographic performance. The present inventors disclose a moisture-proof technology in Japanese Patent Application No. 152127/1993. This technology has been improved to be the technology of the present invention.

The second object of the invention is to provide a device for replenishing solid processing agent used in a light-sensitive material processing apparatus wherein solid processing agents are surely prevented against moisture and stable photographic performance can be obtained through sure operation.

The aforementioned accommodating container is charged in a accommodating container charging section, and then an opening/closing cover is slid on the accommodating container charging section so that an opening thereof is opened and processing agents housed in a main body of the accommodating container are replenished.

Due to the structure wherein the opening/closing cover is slid on the main body of the accommodating container to make an opening, when the opening/closing cover is opened accidentally through careless handling, processing agents leak out of the opening. When the accommodating container falls due to the erroneous handling of an operator, the opening/closing cover is sometimes opened by the falling an processing agents leak out of the opening. Further, when a child instead of the operator mentioned above takes out the stored accommodating container for fun, there is a fear that the opening/closing cover is opened.

For example, therefore, it is considered that the opening/closing cover is sealed in advance after processing agents are housed in the main body of the accommodating container so that the opening/closing cover may not be slid. However, this requires a fob of peeling a seal, which is troublesome. Even when a means other than a seal is used to prevent the sliding of the opening/closing cover, a job to control sliding is required and it is troublesome in handling.

And that, when the opening/closing cover is handled carelessly when it is mounted slidably on an accommodating container charging section of a light-sensitive material processing apparatus, or when the accommodating container is dropped through an erroneous operation of an operator, the opening/closing cover is sometimes opened and processing agents leak.

The accommodating container charging section of the light-sensitive material processing apparatus is under the conditions of high temperature and high humidity, and when the space for the accommodating container charging section is large, an amount of air containing moisture is larger accordingly, affecting processing agents having moisture-absorbing property adversely.

Third object of the invention is to provide an accommodating container wherein the structure for locking an opening/closing cover is simple and no special lock-releasing operation is required, therefore, it is easy to handle, the structure for releasing lock is simple, space for mounting can easily be secured and less space for mounting can lessen moisture-containing air, resulting in an excellent system that processing agents having moisture-absorbing property absorbs less moisture.

SUMMARY OF THE INVENTION

The aforesaid first object to provide a device for replenishing solid processing agent used in a light-sensitive material processing apparatus wherein prevention of erroneous operation in inserting and removing an accommodating container for solid processing agents and/or easy operation in inserting and removing an accommodating container are improved can be attained by the following means. Namely, they are as follows.

First example

An apparatus for supplying a solid processing agent to a processing tank of a photographic material processing apparatus, comprising an accommodating container in which a solid processing agent is stored; a container holder to hold the accommodation container, wherein the container holder is moved together with the accommodation container the between at least two positions, on a first position of which the accommodation container is mounted on or dismounted from the container holder and on a second position of which the solid agent processing agent is dischared from the accommodation container; a supply device to receive the processing agent from the accommodation container on the second position and to supply the processing agent to the processing tank; urging means for applying an urging force to urge the accommodation container toward the supply device on the second position; releasing means for releasing the accommodation container from the urging force and for allowing the accommodation container to move toward the first position; and put-back means for putting the solid processing agent back into the accommodation container when the accommodation container is moved from the second position to the first position.

Second example

A device for replenishing solid processing agent used in a light-sensitive material processing apparatus, the device replenishing solid processing agents contained in an accommodating container to a processing tank for processing, wherein there are provided an accommodating container containing said solid processing agents and having its unsymmetrical sectional view on a plane perpendicular to the direction for inserting the accommodating container into the light-sensitive material processing apparatus and a container-charging means having its sectional view in a shape engaging with the accommodating container on a plane perpendicular to the direction for inserting the accommodating container, and thereby erroneous insertion of the accommodating container can be prevented.

A shape of the aforesaid accommodating container charging means that engages with the accommodating container on a plane perpendicular to the direction for inserting the accommodating container is a part of a shape of a handle member having a handle.

Third example

A device for replenishing solid processing agent used in a light-sensitive material processing apparatus, the device replenishing solid processing agents contained in an accommodating container to a processing tank for processing, wherein there are provided aforementioned accommodating container containing solid processing agents, a container-charging means that accepts the container, a handle member having a handle provided on the accommodating-container-charging means, a handle spring member that pushes up the handle member to its erected position and a fixed frame member that holds the accommodating-container-charging means and is moved by the handle member, and thereby, the accommodating container can be taken out easily through a taking-out operation by means of the handle member.

Fourth example

A device for replenishing solid processing agent used in a light-sensitive material processing apparatus, the device replenishing solid processing agents housed in an accommodating container to a processing tank for processing, wherein there are provided an accommodating container that contains the solid processing agents and a handle member having a shape for regulating the position of the accommodating container when it is inserted or drawn out and being provided on an accommodating-container-charging means that accepts the accommodating container, and thereby the position of the accommodating container can be regulated when it is inserted or drawn out.

An effect derived from the above constitution will be explained as follows.

As stated above, due to a means wherein solid processing agents are pressed back while an accommodating container holding means moves from the position where processing agents are supplied to the position where the accommodating container is charged or removed, the accommodating container can be removed safely even when the accommodating container contains supplied objects. This represents that an accommodating container containing supplied objects can be removed before all of the supplied objects therein are used up, making it possible to take action quickly for improper supply of processing agents in a light-sensitive material processing apparatus that employs solid processing agents, which is a great effect.

The second example is derived from the constitution wherein there are provided an accommodating container containing said solid processing agents and having its unsymmetrical sectional view on a plane perpendicular to the direction for inserting the accommodating container into the light-sensitive material processing apparatus and a container-charging means having its sectional view in a shape engaging with the accommodating container on a plane perpendicular to the direction for inserting the accommodating container, and thereby erroneous insertion of the accommodating container can be prevented.

The third example is derived from the constitution wherein there are provided aforementioned accommodating container containing solid processing agents, a container-charging means that accepts the container, a handle member having a handle provided on the accommodating-container-charging means, a handle spring member that pushes up the handle member to its erected position and a fixed frame member that holds the accommodating-container-charging means and is moved by the handle member, and thereby, the accommodating container can be taken out easily through a taking-out operation by means of the handle member.

The fourth example is derived from the constitution wherein there are provided an accommodating container that contains the solid processing agents and a handle member having a shape for regulating the position of the accommodating container when it is inserted or drawn out and being provided on an accommodating-container-charging means that accepts the accommodating container, and thereby the position of the accommodating container can be regulated when it is inserted or drawn out.

Second object for securing moisture-proofing mentioned above can be attained by the following constitution.

Fifth example

A device for replenishing solid processing agent used in a light-sensitive material processing apparatus, the device replenishing solid processing agents to processing tanks wherein there are provided an accommodating container containing the solid processing agents, a supply means that charges the processing agents contained in the accommodating container to the processing tanks, a packing member that seals between the accommodating container and the supply means with weak depressing force, and a space between the accommodating container and the supply means is sealed by weak depressing force.

A section of the packing member is V-shaped, a hollow circular shape, a wave form, a comb shape, a hollow elliptical shape, U-shaped or those similar to the foregoing.

Sixth example

A device for replenishing solid processing agent used in a light-sensitive material processing apparatus, the device replenishing solid processing agents to processing tanks wherein there are provided a supply means that charges solid processing agents contained in the accommodating container to processing tanks, a processing agent accepting member that accepts the solid processing agent from the accommodating container, and a processing agent accepting moisture-proof member, and thereby moisture-absorption is prevented.

There is provided a depressing spring member that depresses the processing agent accepting moisture-proofing member to the inner wall of a casing of the supply means.

In this case, a solid processing agent includes a tablet-type processing agent and a granule-type processing agent which are formed into a certain shape through compressing powder and granule respectively. Packing member sealed with weak depressing force is characterized in that the packing member is an elastic member such as, for example, synthetic rubber, and it is sealed with weak depressing force so that deformation of the packing member caused by depression absorbs an error of an mount of depression displacement, being accompanied at least by bending deformation.

An effect derived from the above constitution will be explained as follows.

In the fifth example, a packing member is provided between an accommodating container containing solid processing agents and a supply means that charges solid processing agents contained in the accommodating container to the processing tanks, and this packing member is pressed by a pressing means. The packing member is sealed with weak pressing force so that its deformation is accompanied by at least bending deformation and absorbs an error of an amount of pressing displacement. Thus, sure sealing is secured even when the flatness of the surface where the accommodating container is attached is poor and there is an error of an amount of compression displacement.

A section of the packing member is V-shaped, a hollow circular shape, a wave form, a comb shape, a hollow elliptical shape, U-shaped or those similar to the foregoing, and the packing member is sealed with weak pressing force so that the deformation of the packing member caused by pressing is accompanied at least by bending deformation and an error in compression displacement amount can be absorbed.

In the 6th example, when solid processing agents contained in the accommodating container are charged in processing tanks, solid processing agents are accepted by a processing agent accepting member from the accommodating container. Next, a processing agent acceptance moisture-proofing member having triplet compound structure including a sliding section that slides at its low friction coefficient, an elastic portion that deforms elastically, and a supporting section that supports the sliding section and the elastic portion is provided on a processing agent accepting section, and it slides linking with rotation of the processing agent accepting member in the inner wall of a casing of the supply means.

When solid processing agents in the accommodating container are charged in a processing tank, the processing agent accepting member accepts the processing agents form the accommodating container. Next, the processing agent acceptance moisture-proofing member is depressed on the inner wall of a casing by a depressing spring member so that moisture-proofing mainly against vapor generated from a processing tank can be assured.

For attaining the third object relating to the sliding opening/closing cover, the seventh example is characterized in that the accommodating container main body formed to the almost a rectangular parallelopiped capable of containing processing agents for light-sensitive materials is provided with an ejection outlet for ejecting processing agents contained in the accommodating container, an opening/closing cover that slides to open or close the ejection outlet, and further with a lock means the controls the sliding of the opening/closing cover, the lock means being attached on an accommodating container charging section of a light-sensitive material processing apparatus and capable of being released by a lock releasing means provided on the accommodating container charging section.

The eighth example is characterized in that a lock section that engages with a flange of the accommodating container main body and a guide groove that enables the flange to slide are provided on the guide section of the opening/closing cover, and when the flange is engaged with the lock section to close the opening/closing cover for charging the accommodating container in the accommodating container charging section of the light-sensitive material processing apparatus, the opening/closing cover is pushed by the lock releasing means and the flange is moved from the lock section to the guide groove for releasing lock, thus the opening/closing cover is freed to slide.

The ninth example is characterized in the opening/closing cover is closed through engagement on a concave/convex basis between an engagement portion provided on the opening/closing cover and an engagement portion provided on the accommodating container main body, and the opening/closing cover is freed to slide when the lock releasing means attached on the accommodating container charging section of the light-sensitive material processing apparatus presses and moves the engagement section of the opening/closing cover or the engagement section of the accommodating container main body to release the concave/convex engagement.

The tenth example is characterized in that when charging in the accommodating container charging section of the light-sensitive material processing apparatus after closing the opening/closing cover through concave/convex engagement between the engagement section provided on the opening/closing cover and the engagement section provided on the accommodating container main body, the engagement section on the opening/closing cover or the engagement section on the accommodating container main body is pushed and moved by the lock releasing means so that the concave/convex engagement is released to free the opening/closing cover to slide.

In the seventh example, the sliding of an opening/closing cover of the accommodating container main body of an accommodating container for processing agents for light-sensitive materials is controlled by a lock means, and its lock can be released by a lock releasing means when the accommodating container for light-sensitive materials is charged in an accommodating container charging section. Therefore, even when the accommodating container for light-sensitive materials is handled carelessly or it is dropped by erroneous handling of an operator, or even when a child other than the operator plays around with it, the opening/closing cover is never opened.

In the eighth example, an opening/closing cover is closed when a flange of the accommodating container main body is engaged with a lock portion on the opening/closing cover, which means that the structure for locking the opening/closing cover is simple. When the accommodating container for processing agents for light-sensitive materials is charged in the accommodating container charging section of a light-sensitive material processing apparatus, the opening/closing cover is pushed and moved and the flange is moved from the lock portion to a guide groove for releasing lock. Since the lock of the opening/closing cover is released when charging the accommodating container for light-sensitive materials as stated above, erroneous opening of the opening/closing cover can be prevented and special lock-releasing operation is not needed. Therefore, handling is easy, lock-releasing structure is simple, and an installation space can easily be secured.

It is further possible to make the installation space for an accommodating container charging section to be extremely small. Therefore, it is possible to lessen moisture-containing air and thereby to provide an excellent system with less moisture-absorption to processing agents having moisture-absorbing property, although the accommodating container charging section is in the state of high temperature and high humidity.

In the ninth example, an opening/closing cover is closed when an engagement portion provided on the opening/closing cover is engaged with that provided on the accommodating container main body on a concave/convex engagement basis, which means that the structure for locking the opening/closing cover is simple. In addition, when the accommodating container for processing agents for light-sensitive materials charged, the engagement portion of the opening/closing cover or that on the accommodating container main body is pushed and moved to release the concave/convex engagement and thereby the lock of the opening/closing cover is released. Therefore, erroneous opening of the opening/closing cover can be prevented and the structure for releasing lock is simple and an installation space can easily be secured.

It is further possible to make the installation space for an accommodating container charging section to be extremely small. Therefore, it is possible to lessen moisture-containing air and thereby to provide an excellent system with less moisture-absorption to processing agents having moisture-absorbing property, although the accommodating container charging section is in the state of high temperature and high humidity.

In the tenth example, an opening/closing cover is closed when an engagement portion provided on the opening/closing cover is engaged with that provided on the accommodating container main body on a concave/convex engagement basis, which means that the structure for locking the opening/closing cover is simple. When the accommodating container for processing agents for light-sensitive materials is charged, the engagement portion on the opening/closing cover or that on the accommodating container main body is pushed and moved to release the concave/convex engagement, and thereby the lock of the opening/closing cover is released. Since the lock of the opening/closing cover is released when the accommodating container for processing agents for light-sensitive materials is charged as stated above, erroneous opening of the opening/closing cover can be prevented and special lock-releasing operation is not needed. Therefore, handling is easy, lock-releasing structure is simple, and an installation space can easily be secured.

It is further possible to make the installation space for an accommodating container charging section to be extremely small. Therefore, it is possible to lessen moisture-containing air and thereby to provide an excellent system with less moisture-absorption to processing agents having moisture-absorbing property, although the accommodating container charging section is in the state of high temperature and high humidity.

DETAILED DESCRIPTION OF THE PREFERRED EMBODIMENT

Figure 1:
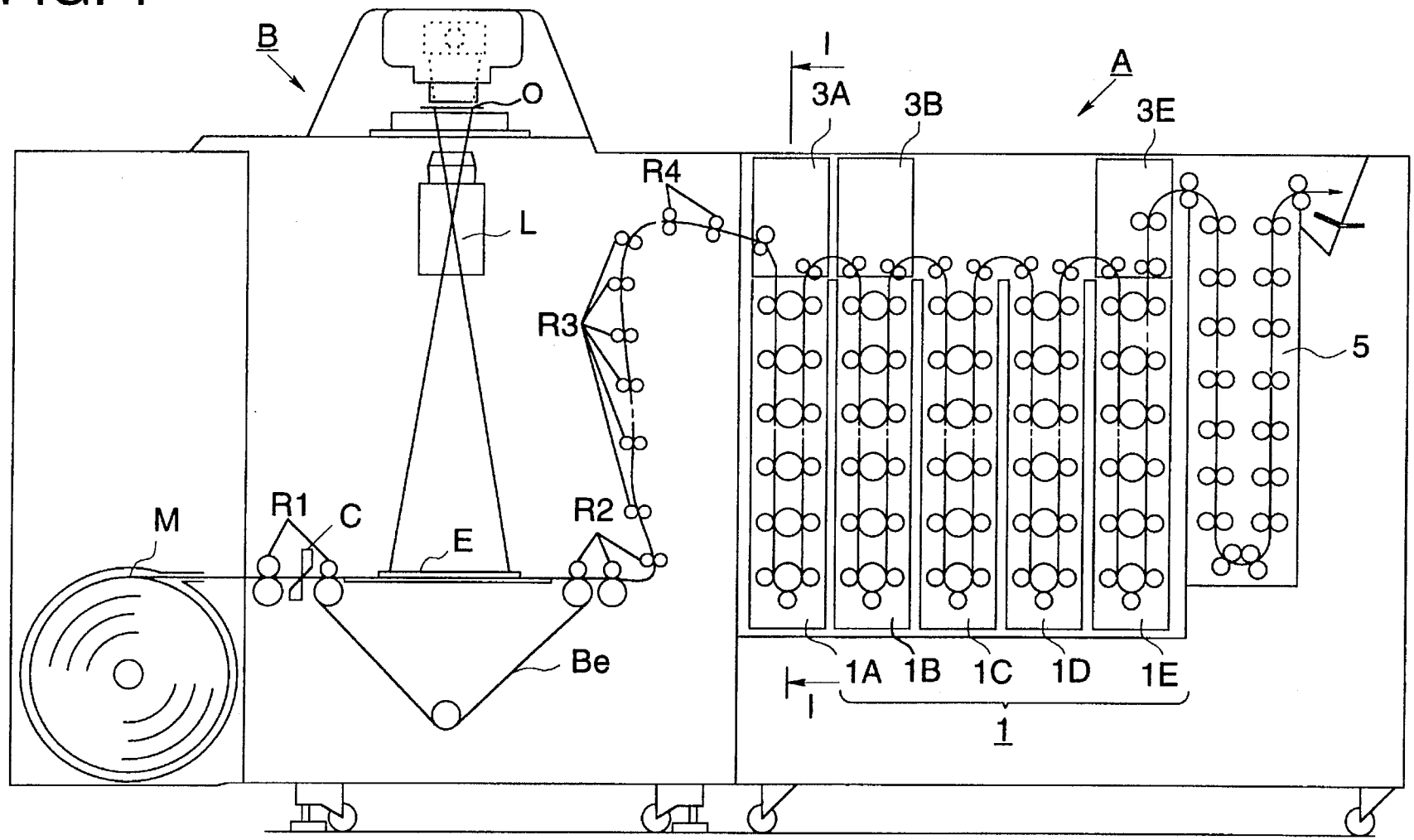
FIG. 1 is a schematic arrangement view of the light-sensitive material processing apparatus.

Next, examples of the device for replenishing solid processing agent used in a light-sensitive material processing apparatus of the invention will be explained as follows, referring to the drawings attached hereto.

An example of an automatic processing apparatus (hereinafter referred to also as an automatic processor simply) will be explained as follows, referring to drawings.

FIG. 1 is a schematic structural diagram of a light-sensitive material processing apparatus (a printer processor) wherein automatic processing apparatus A and printer B are incorporated integrally. At the lower left-hand portion of printer B in FIG. 1, there is installed magazine M housing a roll of photographic paper that is unexposed silver halide photographic light-sensitive material. The photographic paper taken out of the magazine is cut into a predetermined size to be a sheet-shaped photographic sheet through conveyance roller R1 and cutter section C. This sheet-shaped photographic paper is conveyed by belt conveyor means Be to exposure position E where the photographic paper is exposed to an image of a document through a light source and lens L. The exposed sheet-shaped photographic paper is further conveyed by conveyance rollers R2, R3 and R4 each having a plurality of pairs of rollers to be guided into automatic processor A. In the automatic processor A, the sheet-shaped photographic paper is conveyed by roller conveyance means (no symbols are given) to pass successively through the inside of processing tanks such as color developing tank 1A, bleach-fixing tank 1B, and stabilizing tanks 1C, 1D and 1E (that is substantially processing tank 1 of a 3-tank structure) so that processings of color developing, bleach-fixing and stabilizing are carried out. The sheet-shaped photographic paper which has been subjected to the above processings is dried at drier unit 5 to be ejected out of the apparatus.

Incidentally, chain lines in the diagram show a conveyance path for silver halide photographic light-sensitive materials. In the example, the light-sensitive material that is in a cut form is introduced into automatic processor A. However, it may also be introduced into the automatic processor A in a form of a continued belt. In that case, when an accumulator which accumulates light-sensitive materials temporarily is provided between the automatic processor A and photographic printer B, processing efficiency can be enhanced. Further, silver halide photographic light-sensitive materials processed in the automatic processor A of the invention naturally include not only exposed photographic papers but also exposed negative films and others. Though an explanation is made on processing tank 1 that is substantially of 3-tank structure having color developing tank 1A, bleach-fixing tank 1B and stabilizing tanks 1C, 1D and 1E for the invention, the invention is not limited to this, and the invention can also be applied to an automatic processor that is substantially of a 4-tank structure having therein a color developing tank, a bleaching tank, a fixing tank and a stabilizing tank. The aforementioned color developing tank 1A, bleach-fixing tank 1B and stabilizing tank 1E are provided respectively with solid processing agent supplying units 3A, 3B and 3E which supply solid processing agents.

Figure 2:
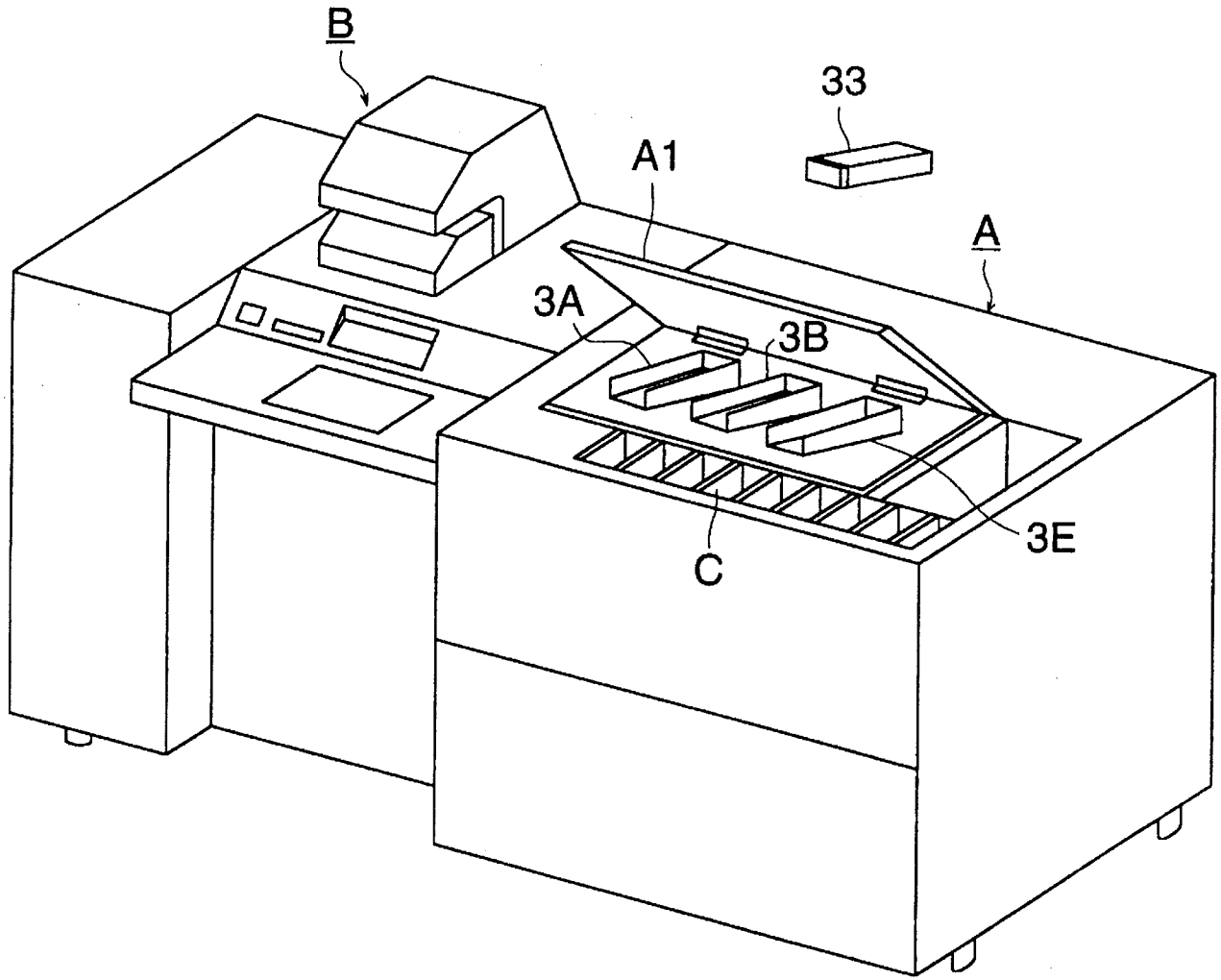
FIG. 2 is a perspective view of the light-sensitive material processing apparatus.

FIG. 2 is a perspective view showing totally a processing apparatus for light-sensitive materials wherein automatic processor A, photographic printer B and sorter C related to the invention are combined integrally. In the figure, cover A1 of the automatic processor A is opened upward so that housing container 33 which houses solid processing agents may be inserted into each of solid processing agent supplying units 3A, 3B and 3E from the upper left corner to the lower right corner in the figure and affixed.

Figure 3:
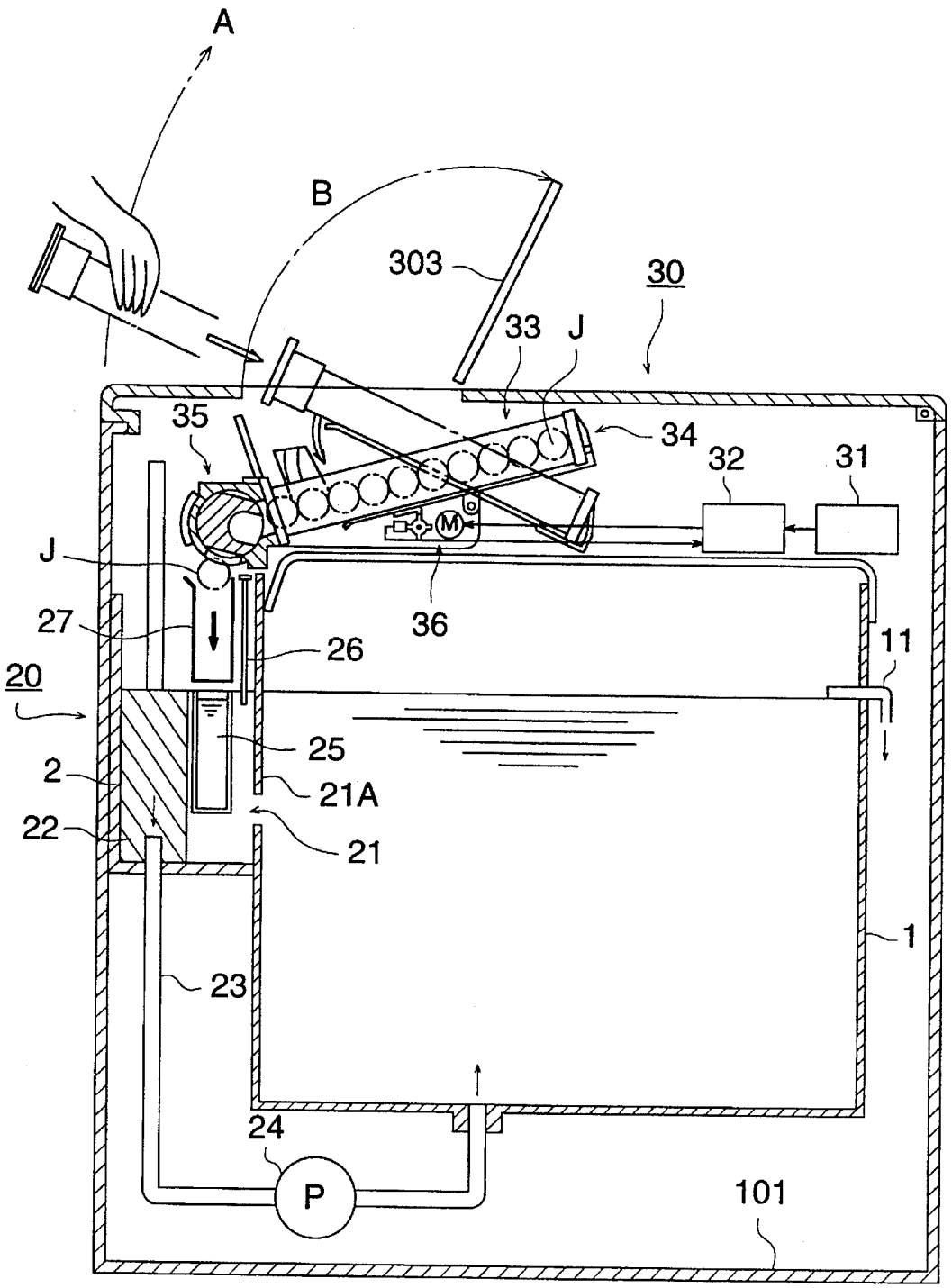
FIG. 3 is a sectional view of the automatic processing apparatus.

FIG. 3 is a sectional view of a processing agent dropping section and a processing agent supplying means both of color developing tank 1A that is a processing tank having a section taken on line I—I of automatic processor A in FIG. 1. Incidentally, since bleach-fixing tank 1B and stabilizing tanks 1C, 1D and 1E are the same as color developing tank 1A in terms of structure, processing tank 1 in the following explanation is assumed to mean any of color developing tank 1A, bleach-fixing tank 1B and stabilizing tanks 1C 1D and 1E. Incidentally, a conveyance means that conveys light-sensitive materials is omitted in the figure for easy understanding of the structure. In the example, an occasion wherein tablets are used as a solid processing agent will be explained.

The processing tank 1 for processing the light-sensitive material includes a solid processing agent charging section 20 for supplying tablets of solid processing agent J, the solid processing agent charging section 20 being integrally provided outside the separation wall of the processing tank 1, and a constant temperature tank 2. The processing tank 1 and constant temperature tank 2 are separated by a partition wall 21A on which a communicating hole 21 is formed so that the processing solution can be communicated through the communicating hole 21. Since an enclosure 25 for receiving the tablets J of solid processing agent is provided in the solid processing agent charging section 20 disposed at an upper position of the constant temperature tank 2, the tablets J of solid processing agent are not moved to the processing tank 1 in the form of a solid body. In this connection, the enclosure 25 is made of material such as a net or filter so that the processing solution can pass through the enclosure 25, however, the tablet J in the form of a solid body can not pass through the enclosure 25 until it is dissolved.

A cylindrical filter 22 is disposed below the constant temperature tank 2 in such a manner that the cylindrical filter 22 can be replaced. The cylindrical filter 22 removes paper scraps and others in the processing solution. A circulation pipe 23 connected with the suction side of a circulation pump 24 (circulation means) is inserted into the filter 22 passing through the lower wall of the constant temperature tank 2.

As shown in FIG. 3, the circulation system includes the circulation pipe 23 forming a circulation passage of the processing solution, and also includes the circulation pump 24 and the processing tank 1. One end of the circulation pipe 23 is communicated with the delivery side of the circulation pump 24, and the other end penetrates a lower wall of the processing tank 1, so that the circulation pipe 23 is communicated with the processing tank 1. Due to the foregoing construction, when the circulation pump 24 is operated, the processing solution is sucked from the constant temperature tank 2 and discharged into the processing tank 1, so that the discharged processing solution is mixed with the processing solution in the processing tank 1, and then sent to the constant temperature tank 2. In this way, the processing solution is circulated. It is preferable that the flow rate of this circulating processing solution is not less than 0.1 with respect to the tank capacity. In this case, the flow rate is defined as a ratio of (an amount of circulating solution in one minute)/(the tank capacity). More preferably, the flow rate is 0.5 to 2.0. The circulating direction of the processing agent is not limited to the direction shown in FIG. 3, but the direction may be reverse to that shown in FIG. 3.

A waste solution pipe 11 is provided for permitting the processing solution in the processing tank 1 to overflow, so the solution level can be maintained constant and an increase in the components conveyed from other tanks into the processing tank 1 can be prevented. Further, an increase in the components oozing out from the light-sensitive material can be prevented.

A rod-shaped heater 26 penetrates an upper wall of the constant temperature tank 2, and is dipped in the processing solution in the constant temperature tank 2. The processing solution in the constant temperature tank 2 and processing tank 1 is heated by this heater 26. In other words, the heater 26 is a temperature regulating means for regulating the temperature of the processing solution in the processing tank 1, so that the temperature can be controlled in an appropriate range, for example, in a range from 20° to 55° C.

A throughput information detecting means 31 is disposed at an entrance of the automatic developing apparatus A, and detects the throughput of the light-sensitive material to be processed. This throughput information detecting means 31 is comprised of a plurality of detecting members that are disposed in a transverse direction. This throughput information detecting means 31 detects the width of light-sensitive material, and the result of detection is used for counting the detection time. Since the conveyance speed of light-sensitive material is previously set in a mechanical manner, the throughput of light-sensitive material, that is, the area of processed light-sensitive material can be calculated form the width and time information. An infrared ray sensor, microswitch and ultrasonic sensor capable of detecting the width and conveyance time of light-sensitive material can be used for this throughput information detecting means 31. A means for indirectly detecting the area of processed light-sensitive material may be used for this throughput information detecting means 31. For example, in the case of the printer processor shown in FIG. 1, a means for detecting an amount of printed light-sensitive material may be adopted, or alternatively, a means for detecting an amount of processed light-sensitive material, the area of which is predetermined, may be adopted. Concerning the detecting time, in this example, detection is carried out before processing, however, detection may be carried out after processing or while the light-sensitive material is being dipped in the processing solution. In these cases, the throughput information detecting means 31 may be disposed at an appropriate position so that detection can be conducted after processing or while the light-sensitive material is being processed. In the above explanation, detection is conducted on the area of processed light-sensitive material, however, the present invention is not limited to the specific example. For example, any values proportional to the throughput of light-sensitive material may be adopted. For example, a concentration of the processing solution in the processing tank or a change in the concentration may be used. It is not necessary to provide the throughput information detecting means 31 for each processing tank 1A, 1B, 1C, 1D, 1E, and it is preferable that one throughput information detecting means 31 is provided for one automatic developing apparatus A. Reference numeral 32 is a throughput supply control means for controlling the supply of processing solution in accordance with a signal sent from the throughput information detecting means 31.

The solid processing agent replenishing device 30 used for the light-sensitive material processing apparatus of the present invention is disposed above the light-sensitive material processing apparatus, and comprises an accommodating container 33, accommodating container charging means 34, supply means 35 and drive means 36, wherein the solid processing agent replenishing device 30 is tightly closed by an upper cover 301. The upper cover 301 is rotatably connected with a main body 101 accommodating the processing tank 1 and constant temperature tank 2, through a support shaft 302 attached to the back of the main body. The upper cover 301 is lifted upward as shown by a one-dotted chain line in FIG. 3, so that the front and upper portions of the apparatus can be widely opened. In this way, inspection of the solid processing agent replenishing device 30, and replacement of the filter 22 can be easily conducted.

A skylight 303 is rotatably connected with a portion of the upper surface of the upper cover 301. When the skylight 303 is opened as illustrated by a one-dotted chain line B in the drawing, the accommodating container 33 is attached or replaced.

Figure 4:
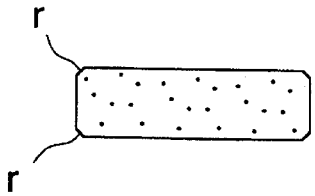
FIGS. 4(A)–4(E) are sectional view and perspective views showing various configurations of the tablet type solid processing agent
Figure 4:
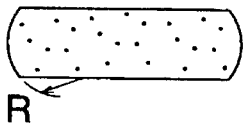
Figure 4:
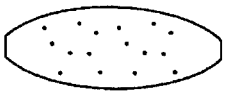
Figure 4:
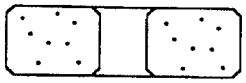
Figure 4:
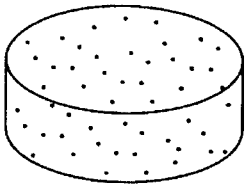

FIG. 4 shows various configurations of the tablet type solid processing agent J. FIG. 4(A) is a sectional view of the cylindrical flat tablet type solid processing agent J, wherein the configuration is circular and the corners are chamfered by the radius of curvature of r. FIG. 4(E) is a perspective view of the tablet type solid processing agent J. FIG. 4(B) is a sectional view of the flat tablet type solid processing agent J, wherein the configuration is circular, and the upper and lower surfaces are flat, and the circumferential surface is formed convex by the radius of curvature of R. FIG. 4(C) is a sectional view of the tablet type solid processing agent J, wherein the configuration is flat, and the upper and lower surfaces are formed spherical. FIG. 4(D) is a sectional view of the tablet type solid processing agent J, wherein the configuration is a doughnut-shape having a hole at the center.

Figure 5:
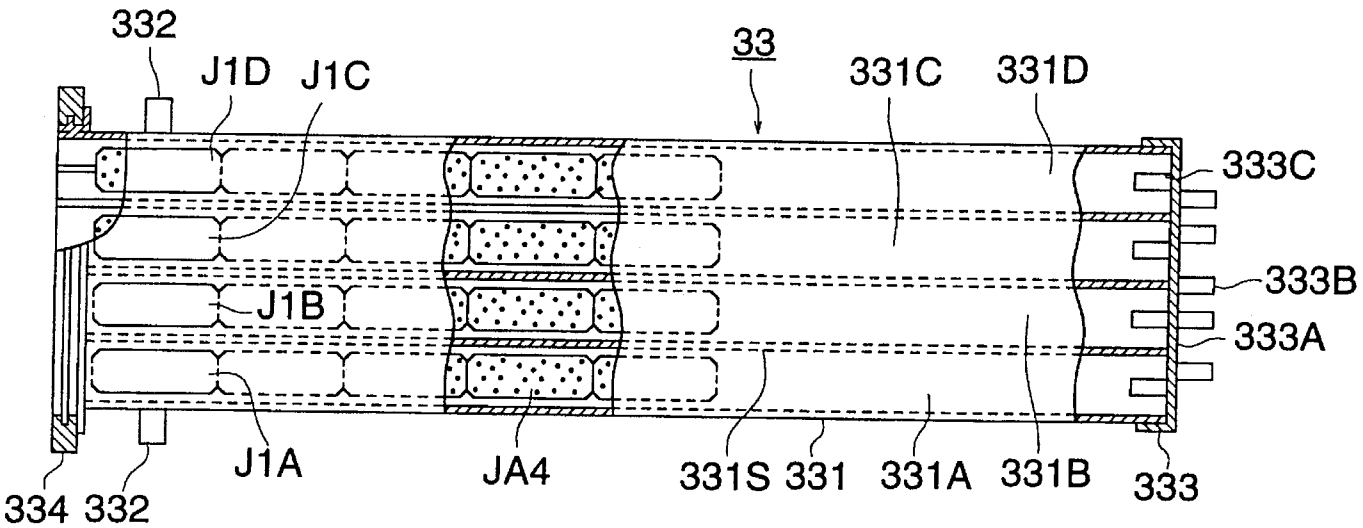
FIGS. 5(A) and 5(B) represent a plan view and side view of the accommodating container for accommodating the solid processing agent.
Figure 5:
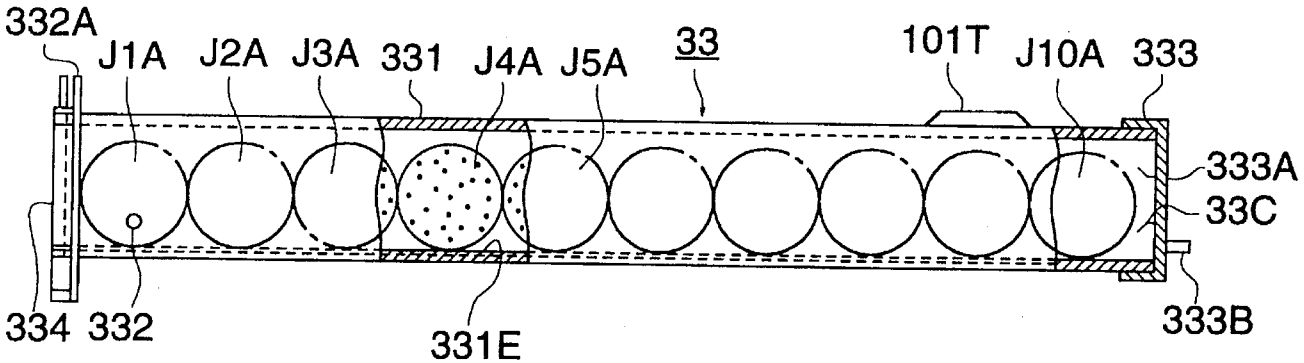
Figure 6:
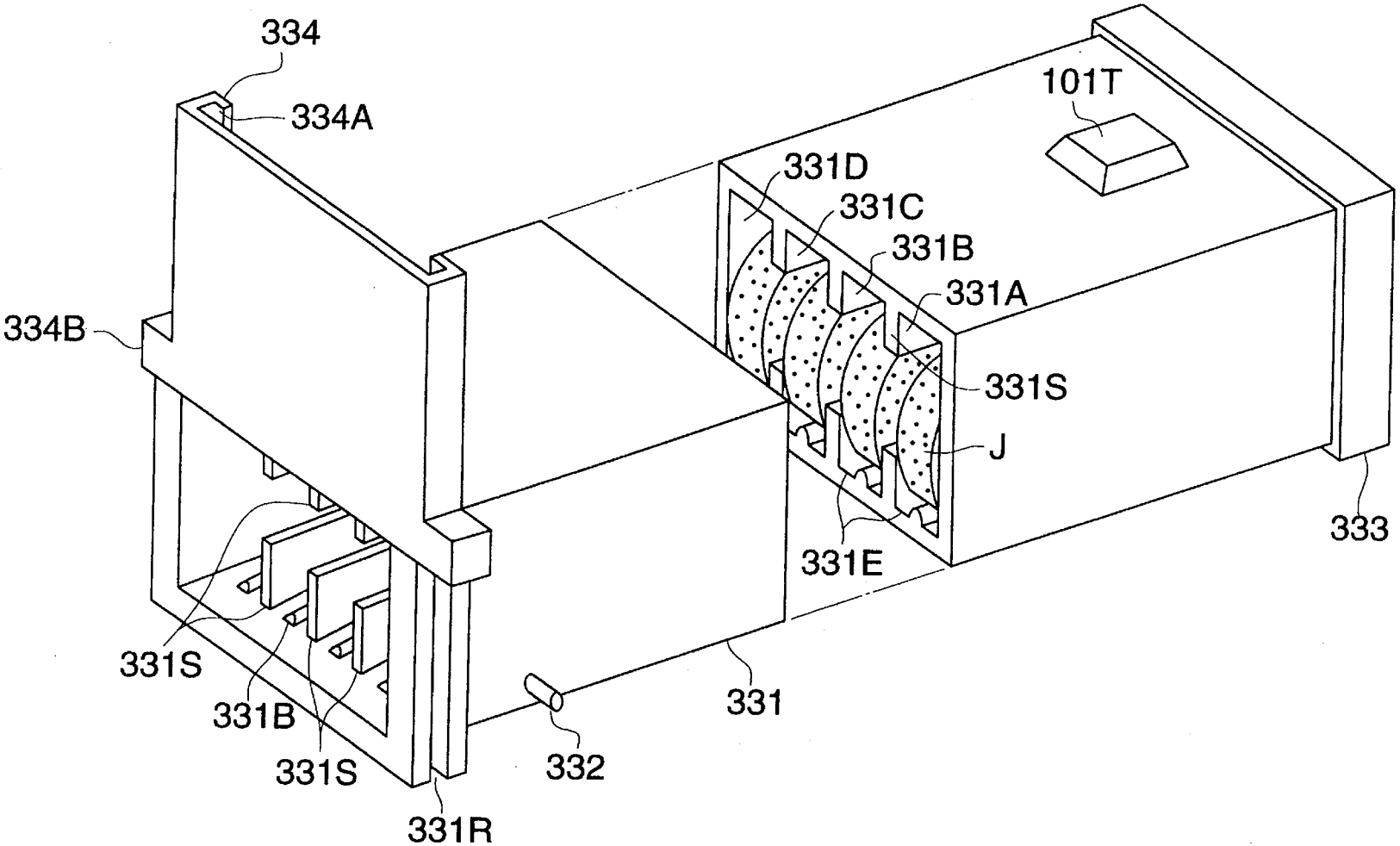
FIG. 6 is a perspective view of the accommodating container.

FIG. 5 is a view showing the accommodating container (cartridge) 33 for accommodating the tablet type solid processing agent J. FIG. 5(A) is a plan view including a partially cutaway view. FIG. 5(B) is a side view of the accommodating container 33. FIG. 6 is a perspective view of the accommodating container 33, wherein a portion is partially cutaway. The accommodating container 33 includes: a container main body 331, the configuration of which is like a hollow square hole, the container main body 331 having a discharge opening through which the tablet of solid processing agent can be discharged; a cap member 333 for closing the other opening of the container main body 331; and a sliding cover 334 capable of being moved upward and downward, wherein the sliding cover 334 slides on a rail 331R of the container main body 331.

Three sets of partition walls 331S are integrally fixed inside the container 331, so that the inside of the container 331 is divided into four chambers 331A, 331B, 331C, 331D. In each chamber, the approximately cylindrical tablets of solid processing agent J are longitudinally accommodated under the condition that each outer circumference is externally contacted with the inside wall of the chamber. Specifically, 10 tablets of solid processing agent J1A to J10A are accommodated in the first chamber 331A, and 10 tablets of solid processing agent J1B are accommodated in the second chamber 331B. In the same manner, the tablets J1C and J1D are respectively accommodated in the chambers. This partition wall 331S does not need to be continuous from the top to the bottom inside the container. The length of the partition wall which makes solid processing agent J to be contained in single file with its external circumference being circumscribed each other is enough.

However, it is preferable that the partition wall 331S is structured to be continuous from the top to the bottom, from the viewpoint of the strength of the container, prevention of a deformation in the assembling process in production, and production efficiency.

A projection 331E is projected from the bottom surface of each chamber of the container main body 331. This projection 331E comes into a point of the outer circumferential surface of the tablet of solid processing agent J, so that the tablet can be easily moved, and powder separated from the tablet of solid processing agent J drops from the top of the projection 331E. Separated powder accumulates in a groove formed under the projection 331E. Accordingly, even when the powder is deposited in the groove, no problems are caused because the tablet of solid processing agent J moves on the projection 331E. The number of this projection 331E may be not less than 2. The projection 331E may be a groove on the contrary to the projection.

A rail 332A is provided on both outer sides of the discharge opening, and slidably engages with grooves 334A formed on both sides of the sliding cover 334. Projections 334B projecting from both lower ends of the sliding cover 334 engage with opening and closing regulating members 355 described later, so that the sliding cover 334 can be automatically closed. The opening and closing regulating member 355 prevents the sliding cover 334 from being disengaged from the rail 332A.

Guide pins 332 are protruded from both sides of the container main body 331, and engages with guide grooves 341D of the accommodating container charging means 34 described later.

The back surface 333A of the cap member 333 is pushed by a resilient pushing member 343C of the accommodating container charging means 34 described later, so that the accommodating container 33 is pressed against a reference surface of the supply means 35. When a leaf spring 345 pushes a guide pin 332 of the accommodating container 33, the accommodating container 33 is pressed against the reference surface. A plurality of discriminating projections 333B are integrally provided on the back surface 333A of the cap member 333, and a wrong accommodating container 33 in which a different processing agent is accommodated is prevented from being mounted.

A cushion member 333C having a buffer effect is provided solidly inside of the back surface 333A of the cap member 333 so that packed solid processing agent J may be protected against oscillation and shock during transportation and storage of the accommodating container 33.

The accommodating container 33 mentioned above is made of resin material or thick paper material subjected to moisture-proof treatment. Appropriate resin material includes polyethylene resin, polypropylene resin, polystyrene resin and ABS resin. The accommodating container 33 is manufactured through injection molding wherein the aforementioned materials are used. Incidentally, on a part of the partition wall 331S inside the container main body 331, there is provided a cutout which lessens inclination of a core of a metal mold and makes it possible to obtain a highly accurate and stable molded product.

Since the aforementioned plural discrimination protrusions (an erroneous-insertion-preventing pin, hereinafter referred to as a pin) are arranged to be deviated from the center line in the vertical direction, the accommodating container 33 can not be inserted reversely into container-holding member 343. In addition, the number and arrangement positions for the aforementioned plural pins 333B vary depending on the kind of solid processing agent J, and some of the illustrated five pins 333B are eliminated and at least two remaining pins 333B are used to discriminate kinds for prevention of erroneous insertion.

Figure 7:
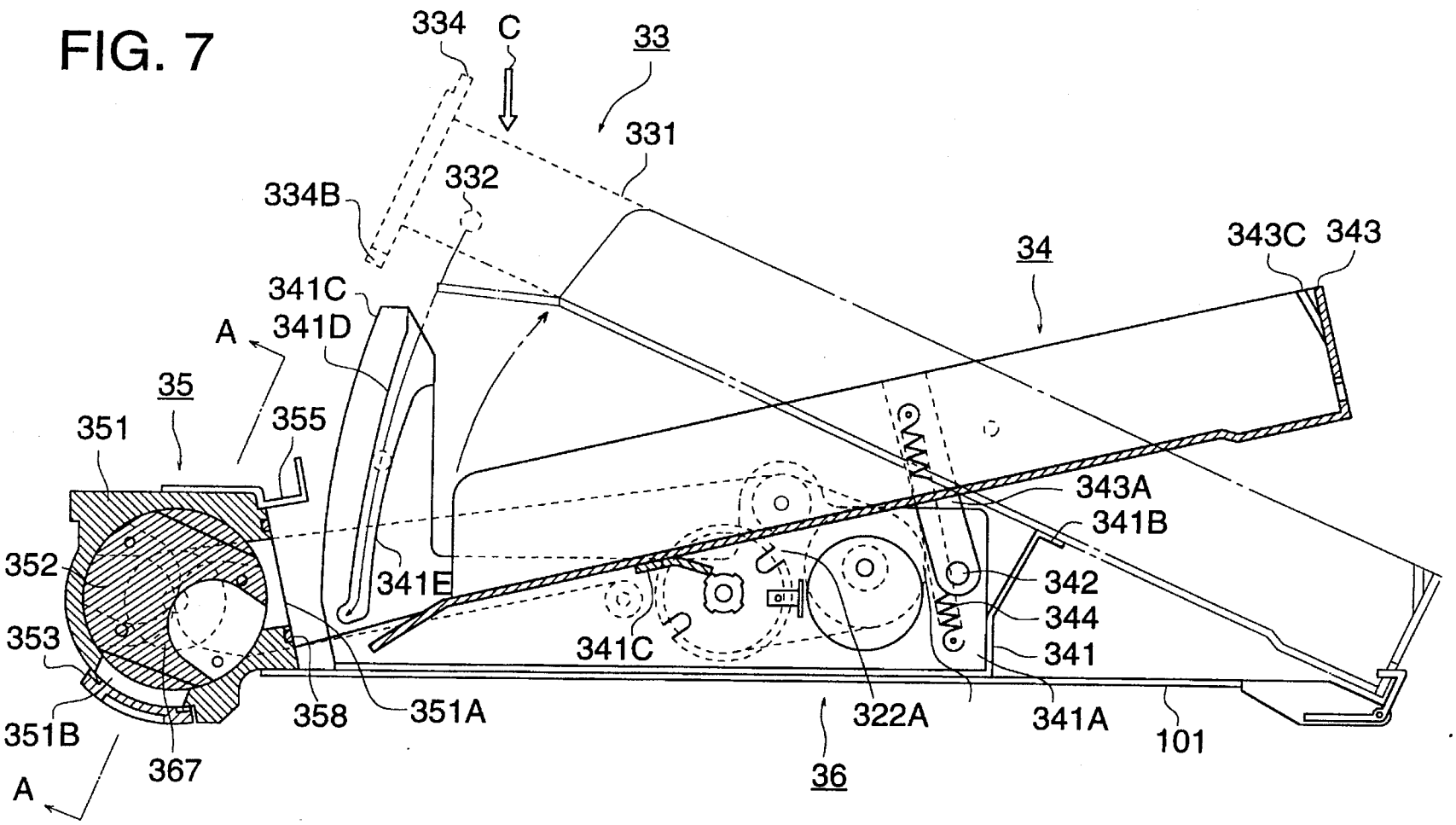
FIG. 7 is a sectional side view of the accommodating container charging means, supply means and a driving means.

FIG. 7 is a sectional side view for explaining the operation of the accommodating container 33, accommodating container charging means 34, supply means 35 and drive means 36.

A fixed frame 341 of the accommodating container charging means 34, a housing member 351 and drive means 36 are fixed on an upper portion of the main body 101.

Support shafts 342 are protruded from both side plates 341A of the fixed frame 341 at the right end shown in the drawing. The support shafts 342 are engaged in holes disposed at a lower end of an arm 343A fixed on both sides of a container holding member 343 for holding the accommodating container 33, so that the container holding member 343 can be oscillated around the support shaft 342. The side plate 341A and arm 343A are respectively provided with a fixing pin, and a tension spring 344 is attached to the fixing pin. Therefore, as illustrated by a one-dotted chain line in the drawing, the container holding member 343 is rotated clockwise being pushed by the spring, and the bottom portion of the container holding member 343 comes into contact with a stopper portion 341B protruding to a right upper portion of the fixed frame 341. Then the movement of the container holding member 343 is stopped, and the container holding member 343 is maintained in a condition before the accommodating container 33 is mounted.

At a position close to the left end of the side plate 341A of the fixed frame 341, there is provided a rising portion 341C, in which a circular guide groove 341D is formed, wherein the circular guide groove 341D is provided around the support shaft 342. The accommodating container 33 is charged to the container holding member 343 of the accommodating container charging means 34, and the accommodating container holding member 343 is oscillated around the support shaft 342, so that the left end portion of the container holding member 343 is pushed downward in the direction C shown in the drawing. Then the guide pin 332 of the accommodating container 33 advances in the guide groove 341D while the guide pin 332 is being pushed downward by a pushing member 343C of the accommodating container charging means 34. An L-shaped groove portion 341E is formed in the lowermost portion of the guide groove 341D. When the pin 332B enters this L-shaped groove 341E being pushed by the pushing member 343C, the front of an outlet member of the accommodating container 33 closely comes into contact with an entrance portion 351A of the supply means 35.

As stated above, the accommodating container charging means 34 can take both the first position where accommodating container 33 is charged and taken out and the second position where the accommodating container charging means is urged toward supply means 35 by pressing member 343C that is an urging means to be in close contact with the supply means 35 for the supply of solid processing agents.

The supply means 35 is disposed in the housing member 351 in such a manner that the supply means 35 can be rotated on an inner circumferential surface of the housing member 351. The supply means 35 includes a rotatable solid processing agent conveying member (rotor) 352, and a shutter section 353 for opening and closing the outlet portion 351B, wherein the solid processing agent conveying member (rotor) 352 has a pocket portion 352A by which a predetermined amount of solid processing agent is received from the inlet portion 351A and moved to the outlet portion 351B.

A frame-shaped resilient packing 358 is embedded in the periphery of the opening on the end surface of the inlet portion 351A of the housing member 351. When the discharge opening of the accommodating container 33 is closely contacted with the inlet portion 351A, the atmosphere can be shut off by the frame-shaped resilient packing 358, so that moisture-proofing effect can be provided.

Figure 8:
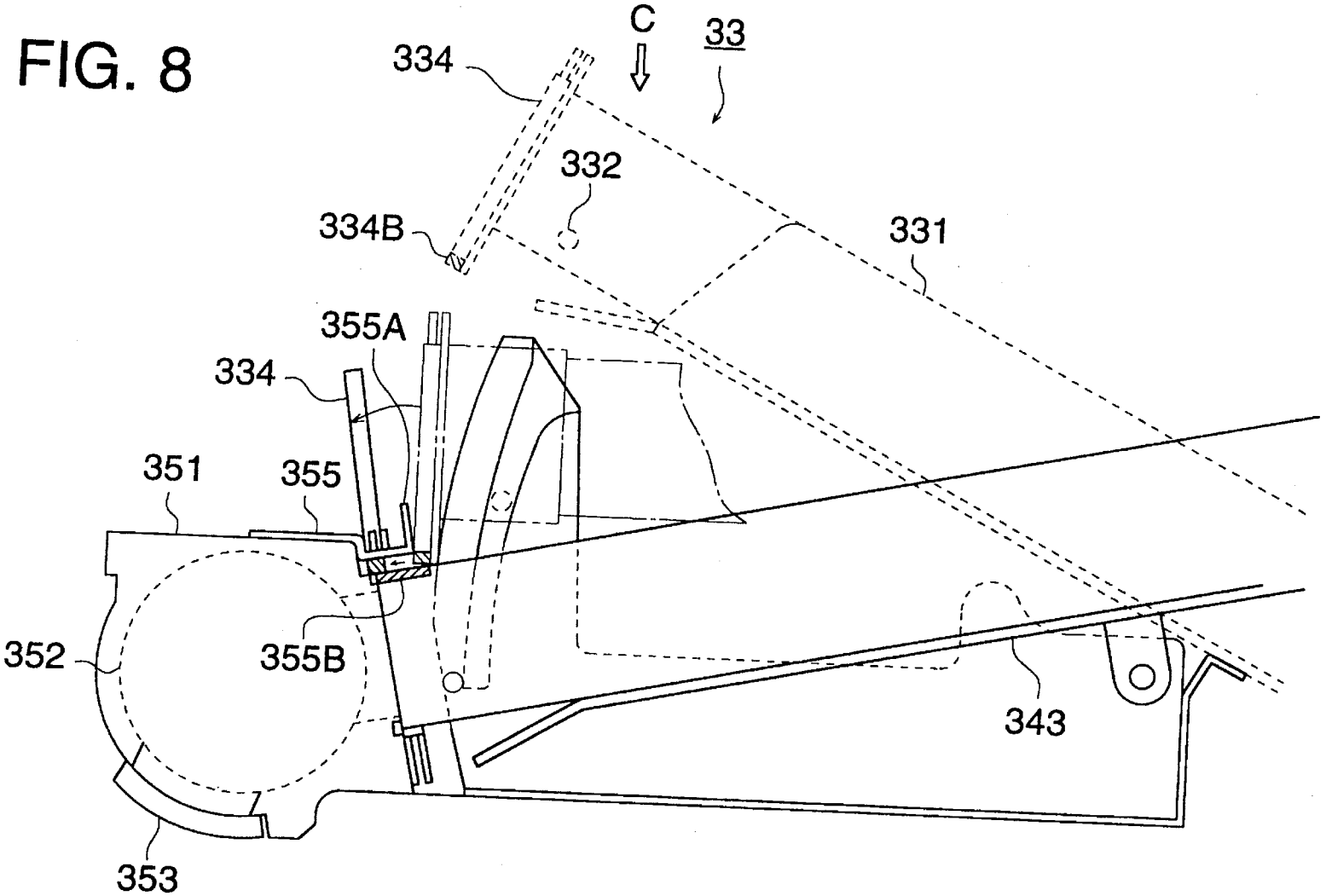
FIG. 8 is a side view for explaining the opening and closing operation of the sliding cover of the accommodating container.

FIG. 8 is a side view for explaining the opening and closing operation of the sliding cover 334 of the accommodating container 33.

At an upper position of the inlet portion of the housing member 351 of the supply means 35, there is provided an opening and closing regulating member 355 for regulating the opening and closing operation of the sliding cover. When the accommodating container 33 provided in the accommodating container charging means 34 is pushed downward from the initial position (shown by a one-dotted chain line) in the direction of arrow C in the drawing, the accommodating container 33 reaches the intermediate position (shown by a one-dotted chain line). Then the descending motion of a protrusion 334B of the sliding cover 334 is stopped by the opening and closing regulating member 355(355B). When the accommodating container 33 is further oscillated, the opening of the outlet opening member 332 of the accommodating container 33 is gradually opened since the sliding cover 334 can not further go downward. When the downward motion of the accommodating container 33 is stopped at a predetermined position, the opening is completely opened, and the solid processing agent tablet J in the first row in the accommodating container 33 is sent to the supply means 35. This complete opening condition is shown by a solid line in the drawing.

When all solid processing agent tablets J in the accommodating container 33 have been successively consumed, a remainder detection signal is generated, and the accommodating container 33 is replaced in accordance with the signal. When the accommodating container 33 is withdrawn backward, the accommodating container 33 and container holding member 343 are rotated clockwise, so that the left end portion is raised. In this ascending process, the opening and closing regulating member 355A stops the motion of the sliding cover 334, and only the main body composed of the container main body 331 and the cap member 333 is raised, so that the opening portion is closed by the sliding cover 334. Further, in the latter half process in which the accommodating container 33 is raised, the apparatus is returned to the initial condition, which is an upper dead point, while the opening portion is in a closed condition. Therefore, powder of the processing agent in the container can be prevented from being scattered. Even when the container is removed for maintenance while the processing agent remains in the container, the processing agent can not be dispersed since the opening portion is in a closed condition.

Figure 9:
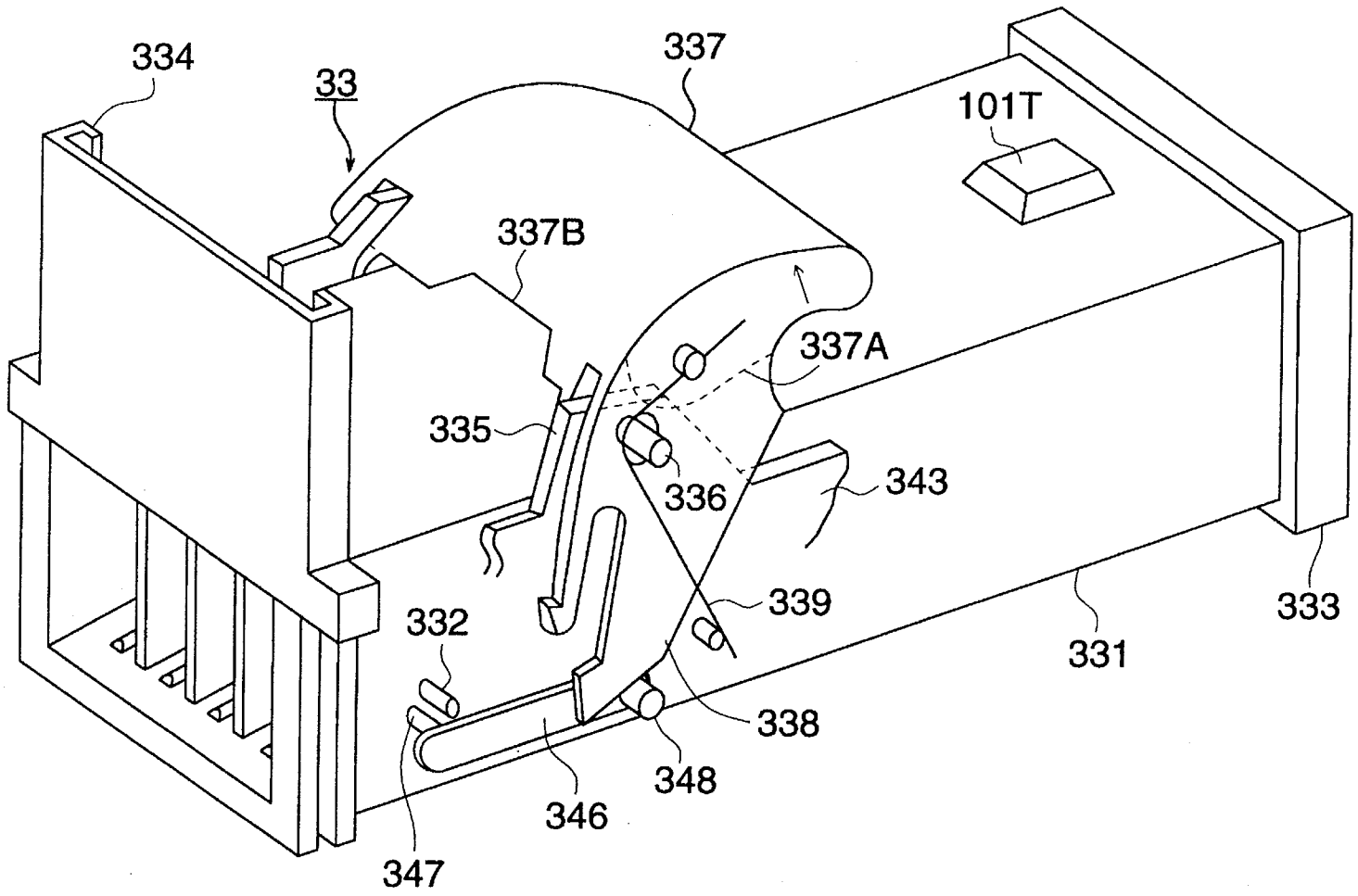
FIG. 9 is a perspective view showing an accommodating-container-charging means.
Figure 10:
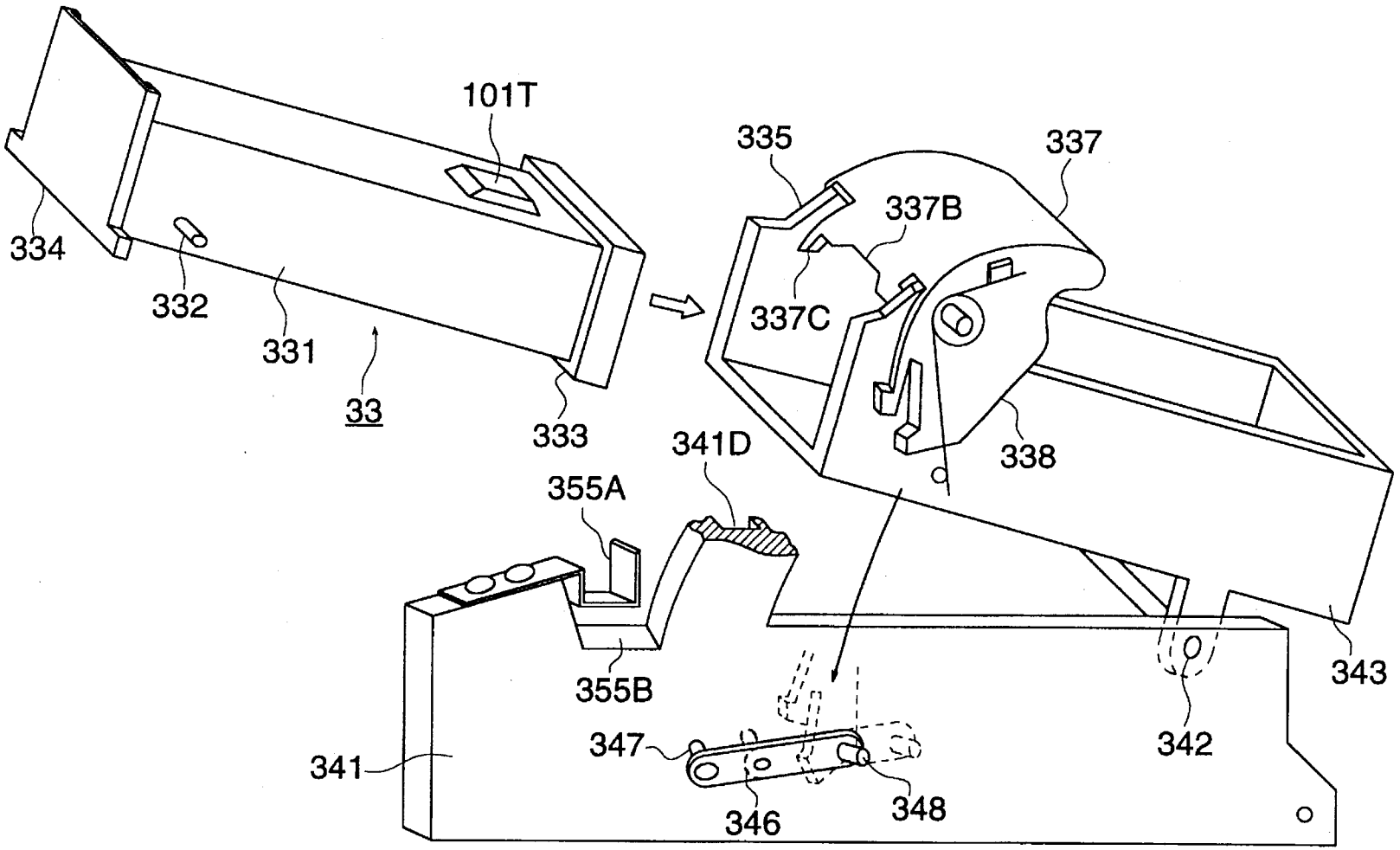
FIG. 10 is a perspective view of the accommodating-container-charging means.

FIG. 9 is a perspective view showing an example of accommodating container 33, and FIG. 10 is a perspective view showing how the accommodating container 33 is mounted on accommodating-container-charging means 34. In the course of inserting the accommodating container 33, when it is inserted at the right position, protruded portion 101T that is a part of an unsymmetrical form which is perpendicular to the direction for inserting the accommodating container passes through recessed portion 337B of handle member 337 that is a part of a shape engaging with the accommodating container so that the accommodating container is inserted. When the accommodating container is inserted at the wrong position, on the contrary, the aforementioned protruded portion 101T is blocked by a part of the container holding member 343 that is a part of the accommodating-container-charging means, and thereby he accommodating container can not be inserted.

The shape of a section including a plane that is perpendicular to the direction for inserting accommodating container 33 needs to be an eccentric shape so that protrusion 101T may be included therein as shown in the figure. If its shape is eccentric, the protrusion may also be a recessed portion. Accordingly, recessed portion 337B provided on handle member 347 that is a part of container holding member 34 is required to be a shape corresponding to the eccentric shape of the accommodating container.

On both sides on the top of the container holding member 343, a pair of shaft supporting members 335 are affixed solidly. On shaft 336 supported by the shaft supporting members 335, handle member 337 is supported rotatably. A part of an inner wall of the container holding member 343 is a part of a shape engaging with the accommodating container 33. The handle member 337 is shaped to be rotated easily with its circular-arc-shaped groove being touched by fingers. One end of handle spring 339 is supported by a protrusion on the handle member 337 and the other end is supported by fixed frame 341 so that the circular arc groove portion of the handle member 337 may be rotated in the arrowed direction shown in the figure. Chamfered portion 337C that is a part of the shape of the handle member 337 makes the accommodating container to be positioned correctly and is a part of the shape that engages with the accommodating container 33. When the accommodating container 33 is placed at a predetermined position on the container holding member 343 of the aforementioned accommodating-container-charging means 34 and the top surface of the handle member 37 is pressed down, bottom end portion 337A of the handle member 37 depresses the top surface of container main body 331, and thereby the accommodating container 33 and the container holding member 343 swivel down to the lower dead point where they are locked by a locking means which will be described later. During this swivel down process, guide pin 332B studded on the side of the accommodating container 33 descends along guide groove 341D provided on the fixed frame 341 of the accommodating-container-charging means 34, and when it arrives at a position near the lower dead point, it is pushed in L-shaped groove 341E urged by elasticity of leaf spring 345 to be bent to an L shape, thus the accommodating container 33 is locked after moving to the left side in the figure.

On one end of the handle member 337, there is provided cam portion 338 that is embodied solidly to be protruded downward. On the other hand, on both side walls of the fixed frame 341, there is supported slide plate 346 in such a manner that it can move straight. In the vicinity of the left side in the figure, there is studded first pin 347. When the guide pin 332 enters the L-shaped groove 341E, the first pin 347 is depressed by the guide pin 332 to be driven toward the left side in the figure, and the slide plate 346 is also stopped at the left side.

In the vicinity of the right side of the slide plate 346 in the figure, there is studded second pin 348.

When the accommodating container 33 needs to be replaced after solid processing agents J therein are used up, or when maintenance is carried out, the handle member 337 is rotated counterclockwise around shaft 336 by hand. Being caused by this rotation, the cam portion 338 also rotates counterclockwise and its tip portion depresses the second pin 348 to move it toward the right side in the figure. Being caused by this movement, the slide plate 346 also slides to the right side, the first pin 347 moves the guide pin 332 toward the right side against the urging force of the leaf spring 345, locking is released at the lower end of arc-shaped guide groove 341D, and urging force of tension spring 344 causes the slide plate to change its moving direction to the upward one and to ascend along guide groove 341D to return to its home position.

Due to the operation of such urging-releasing means, the movement from the second position where the accommodating container charging means is urged toward supply means 35 for the supply of solid processing agents to the first position becomes possible.

Figure 11:
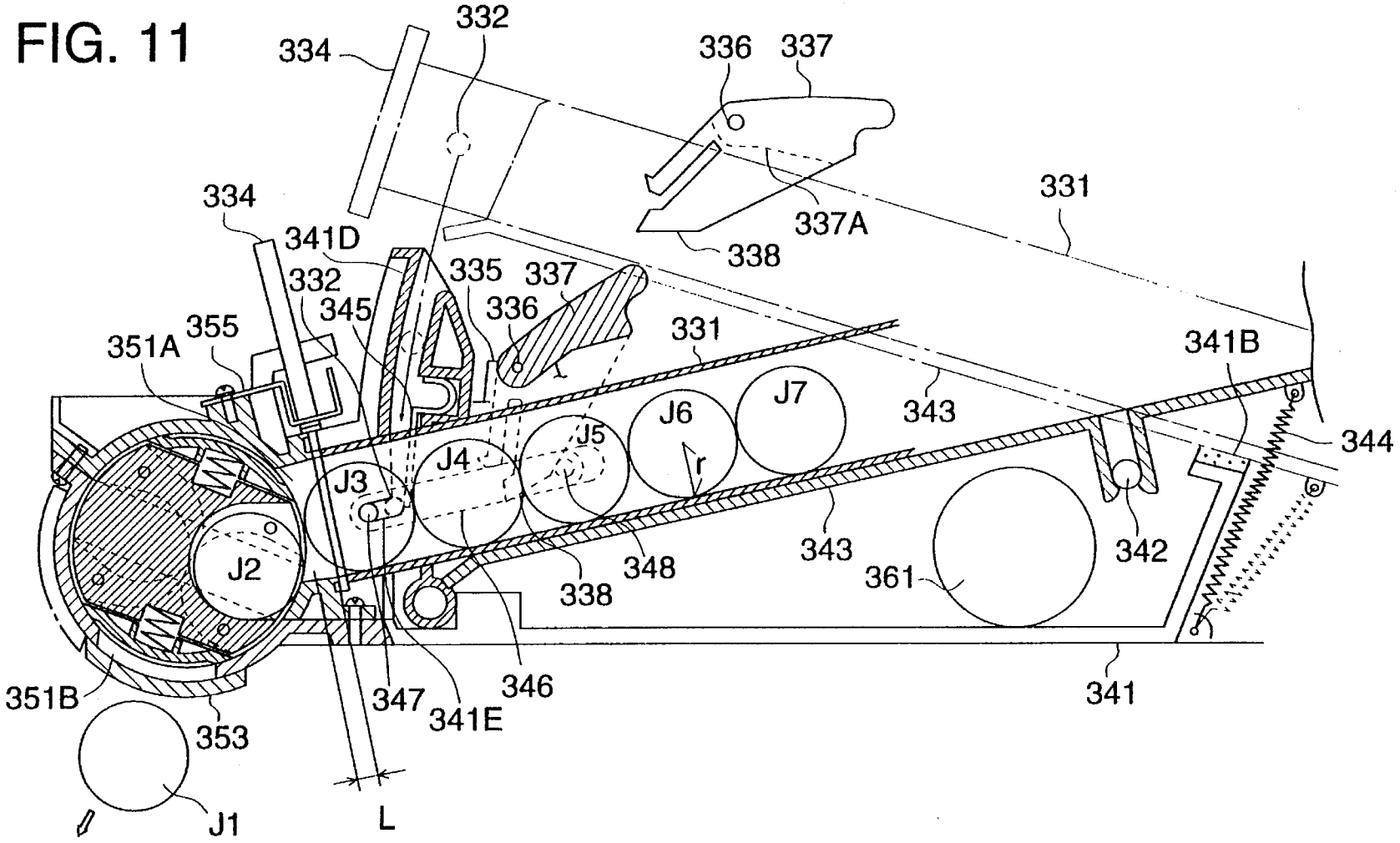
FIG. 11 is a sectional view showing how the accommodating container is charged in the accommodating-container-charging means.

FIG. 11 is a sectional side view of the accommodating-container-charging means. The container holding member 343 and accommodating container 33 return to their home position shown with chain lines, where the accommodating container 33 can be replaced through manipulation of the handle member 337.

In this case, when the accommodating container 33 is removed from a light-sensitive material processing apparatus main body, or when the state of engagement between the accommodating container 33 and the supply means 35 is released, both for the purpose of maintenance or correction of an error of defective supply of processing agents, under the condition shown in FIG. 11 or the condition that is after solid processing agent J2 contained in the supply means 35 has been supplied to a processing tank and before solid processing agent J3 contained in the accommodating container 33 is contained in the supply means 35, the solid processing agent J3 and thereafter contained in the accommodating container 33 do not fall. The correlation between distance L from the accommodating container side edge of solid processing agent conveyance member 352 of supply means 35 to the supply means side edge of container main body 331 of accommodating container 33 on a backwardly retracted condition and the radius r of solid processing agent J contained in the accommodating container 33 satisfies the relation of $L<r$. Therefore, when the operation for removing the accommodating container 33 is started, the accommodating container 33 rotates upward while the solid processing agent J3 is being pressed into accommodating container main body 331 by the top end of inlet portion 351A of housing member 351 of the supply means 35, thus, solid processing agents do not fall. In the case of the relation of $L \geqq r$, pressing into the accommodating container is impossible and solid processing agents stay at the inlet portion 351A of the supply means 35, disabling the accommodating container 33 from being taken out. Therefore, due to a means with above-mentioned structure for pressing back solid processing agents, when removing the accommodating container main body from an apparatus main body before all solid processing agents in the accommodating container 33 are used up, the solid processing agents do not fall before an opening portion of the accommodating container main body 331 is closed completely by sliding cover 334. This means for pressing back solid processing agents is not limited to the above-mentioned example, but it may also be a means wherein solid processing agents are urged back into the accommodating container main body concurrently with urging-releasing operation, being interlocked with the urging-releasing means. In either case, solid processing agents have only to be pressed back by the operation of urging-releasing of an urging means.

As stated above, due to a means wherein solid processing agents are pressed back while an accommodating container holding means moves from the position where processing agents are supplied to the position where the accommodating container is charged or removed, the accommodating container can be removed safely even when the accommodating container contains supplied objects. This represents that an accommodating container containing supplied objects can be removed before all of the supplied objects therein are used up, making it possible to take action quickly for improper supply of processing agents in a light-sensitive material processing apparatus that employs solid processing agents, which is a great effect.

Following effects are derived from the constitution of the invention explained above.

An effect of the second example is derived from the constitution wherein there are provided an accommodating container containing said solid processing agents and having its unsymmetrical sectional view on a plane perpendicular to the direction for inserting the accommodating container into the light-sensitive material processing apparatus and a container-charging means having its sectional view in a shape engaging with the accommodating container on a plane perpendicular to the direction for inserting the accommodating container, and thereby erroneous insertion of the accommodating container can be prevented.

An effect of the third example is derived from the constitution wherein there are provided aforementioned accommodating container containing solid processing agents, a container-charging means that accepts the container, a handle member having a handle provided on the accommodating-container-charging means, a handle spring member that pushes up the handle member to its erected position and a fixed frame member that holds the accommodating-container-charging means and is moved by the handle member, and thereby, the accommodating container can be taken out easily through a taking-out operation by means of the handle member.

Since a shape of the aforesaid accommodating container charging means that engages with the accommodating container on a plane perpendicular to the direction for inserting the accommodating container is a part of a shape of a handle member having a handle, the structure is simple, erroneous insertion can be prevented, and the accommodating container can be loaded or unloaded easily, in addition to the effect of the second example.

An effect of the fourth example is derived from the constitution wherein there is provided a handle that is used when the accommodating container for solid processing agents is inserted into a solid processing agent replenishing unit, and a part of the handle is used as a position correcting means for loading or unloading the accommodating container, thereby the simple structure and sure loading and unloading are obtained.

Figure 12:
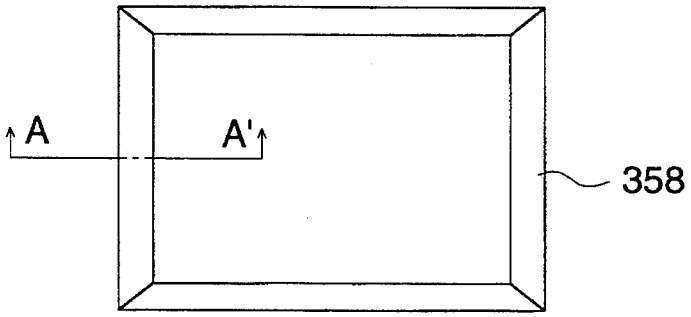
FIGS. 12(A)–12(C) represent a plan view and a sectional view of a packing member.
Figure 12:
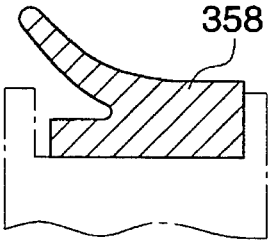
Figure 12:
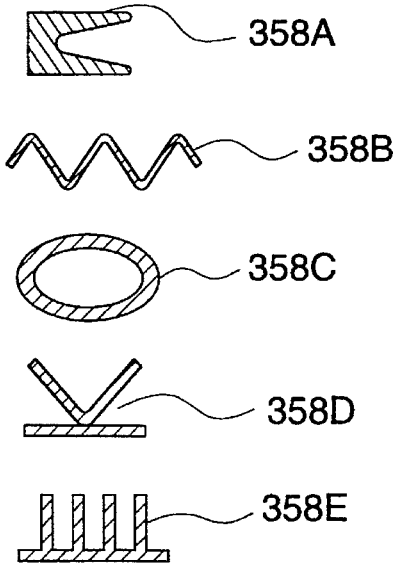

FIG. 12 represents a plan view and a sectional view of a packing member. FIG. 12(*a*) is a plan view of a packing member, FIG. 12(*b*) is a sectional view of the packing member, and FIG. 12(*c*) is a sectional view of other examples of packing member. As shown in the figures, packing member 358 is shaped to cause bending deformation so that sure sealing can be achieved and error in assembling can be absorbed even when the flatness of a depressing surface (a flange of accommodating container 33) is poor and even when there is an error in compression displacement. In the example, a section of a packing member is a rectangular shape and the packing member is surrounded with a V-shaped groove. Packing member 358A of other example has a rectangular section in which a U-shaped groove is formed, packing member 358B has a wave-shaped section and packing member 358C has an elliptical section. Packing member 358D has a vertical V-shaped section and packing member 358E has a comb-shaped section.

Figure 13:
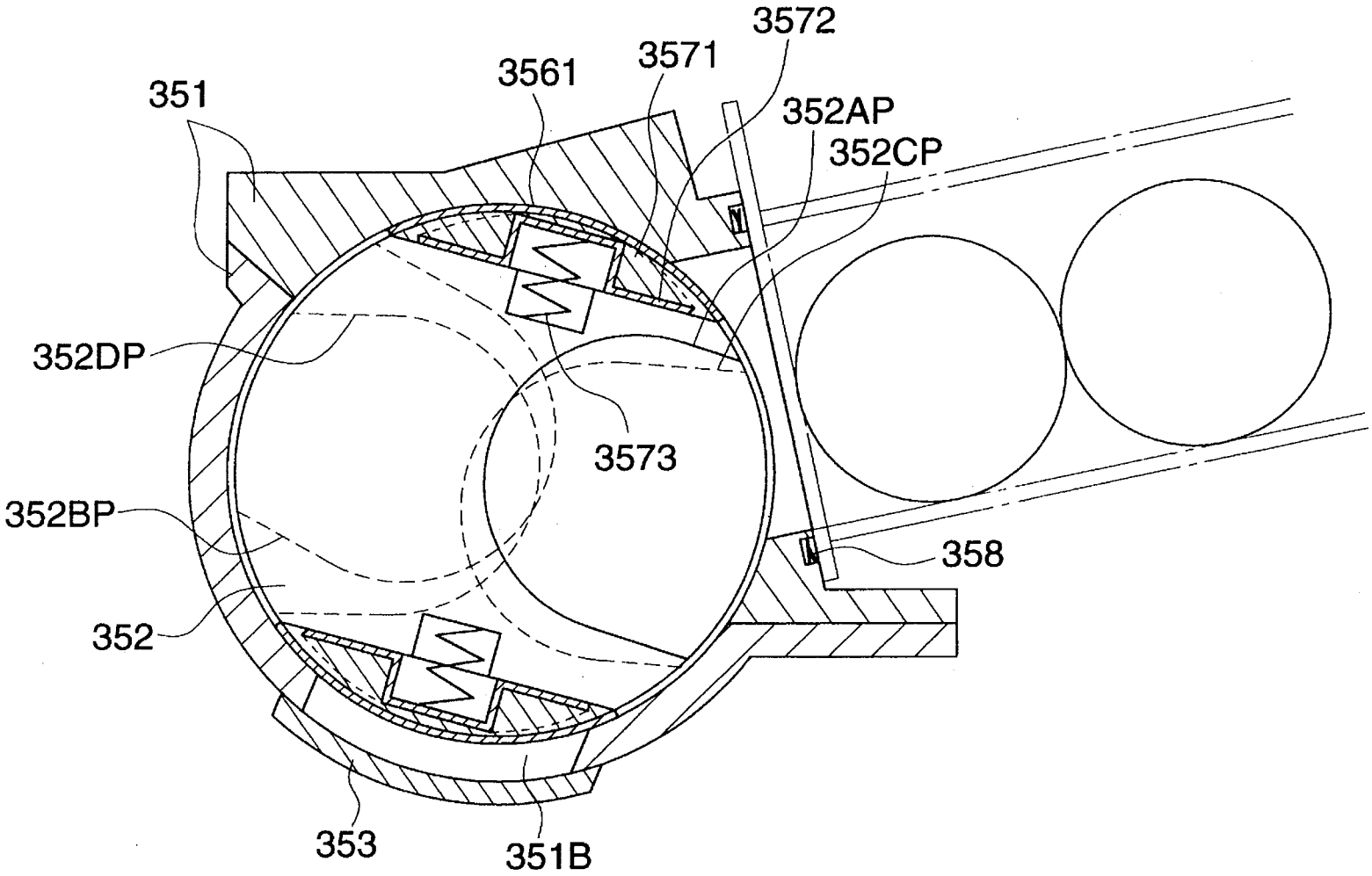
FIG. 13 is an enlarged sectional view of a supply means.

FIG. 13 is an enlarged sectional view of supply means 35. There are provided two processing agent acceptance moisture-proofing members at two locations on the external circumference of rotor 352. The processing agent acceptance moisture-proofing member is of a compound structure and is composed of sliding member 3561 having a low coefficient of friction, elastic member 3571 for improving close contact, and supporting member 3572. Further, the processing agent acceptance moisture-proofing member is structured so that it can rotate with a low torque while it is pressed by pressing spring 3573 against an inner wall of a casing to be in close contact with the inner wall at low pressure. The moisture-proofing member is larger than outlet 351B of housing member 351, and moisture-proofing between housing member 351 and rotor 352 can be kept by the sliding member 3561 that is in surface-contact with an inner surface of the housing member 351. Incidentally, the rotor is provided with pockets 352AP, 352BP, 352CP and 352DP each accepting processing agent.

The outlet 351B of the housing member 351 is capable of being opened and closed by shutter member 353.

The shutter member 353 mentioned above reciprocates along a part of an external circumference of the housing member 351, being linked with rotation of the rotor 352. When the rotor 352 starts rotating, the outlet 351B is opened, and while the rotor 352 makes a half turn, two solid processing agents J are dropped in processing tank 1, and then the outlet 351B is closed.

Figure 14:
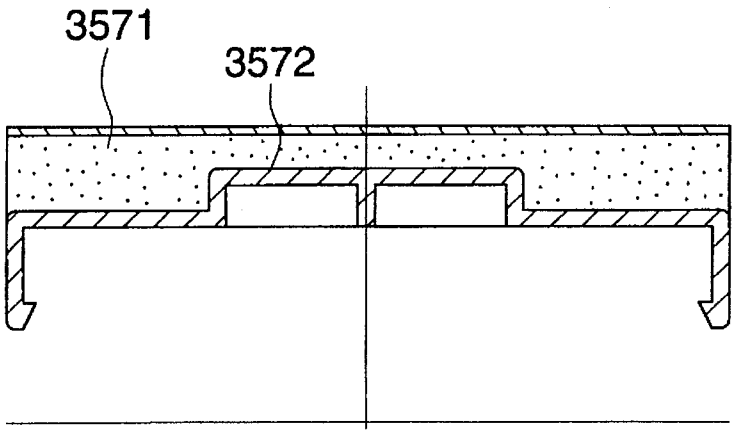
FIGS. 14(A)–14(B) represent a sectional view of a processing agent acceptance moisture-proofing member.
Figure 14:
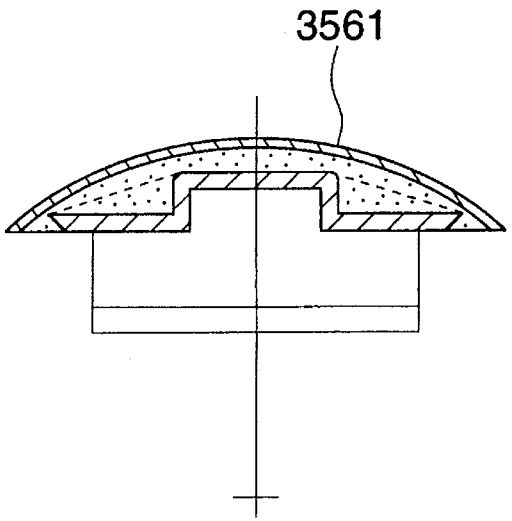

FIG. 14 is a sectional view of a processing agent acceptance moisture-proofing member. FIG. 14(*a*) is a sectional view that passes through the rotational axis and is in parallel with the rotational axis, and FIG. 14(*b*) is a sectional view that is perpendicular to the rotational axis of the rotor. The processing agent acceptance moisture-proofing member is of a triplet compound structure wherein sliding member 3561 is, for example, a Teflon sheet (50 to 500μ) sliding member that slides inside the housing, elastic member 3571 is, for example, NBR40 rubber material having elasticity, and supporting member 3572 is, for example, a PBS resin member supporting the sliding member 3561 and the elastic member 3571.

In the fifth example, when an accommodating container is charged by the use of a packing member that is given bending deformation and/or compression deformation for sealing between the accommodating container housing solid processing agents and a supply means that supplies solid processing agents housed in the accommodating container to a processing tank, the accommodating container can be in close contact at a low pressure and it can be sealed perfectly even when it is positioned wrongly or even when the flatness of the surface for positioning is poor. Thus, the solid processing agent, when it is supplied, is free from moisture-absorption caused by vapor from a processing solution, and moisture-proof state can be kept perfectly, which is effective for stabilized quality.

Due to the shape of a section of the packing member including a V-shape, a hollow circular shape, a waveform, a comb shape, a hollow elliptical shape, a U-shape and those similar to the above, the accommodating container can be in close contact at a low pressure and it can be sealed perfectly even when it is positioned wrongly or even when the flatness of the surface for positioning is poor. Thus, the solid processing agent, when it is supplied, is free from moisture-absorption caused by vapor from a processing solution, and moisture-proof state can be kept perfectly.

In the sixth example, when a solid processing agent housed in an accommodating container is supplied to a processing tank, a processing agent accepting member accepts the solid processing agent from the accommodating container. Then, a processing agent acceptance moisture-proofing member that is of a triplet compound structure including a sliding member, an elastic member and a supporting member slides on an inner wall of a casing. This means that the processing agent acceptance moisture-proofing member of a triplet compound structure of a soft material and a material having a low coefficient of friction rotates at a low torque while being kept in close contact by low pressure, thereby the state of moisture-proofing can be maintained, which is effective for stable quality.

Further, when a solid processing agent housed in an accommodating container is supplied to a processing tank, a processing agent accepting member accepts the solid processing agent from the accommodating container. Then, a processing agent acceptance moisture-proofing member that is of a triplet compound structure including a sliding member, an elastic member and a supporting member slides on an inner wall of a casing while being pressed on the inner wall of the easing by a depressing spring member, thus, the state of moisture-proofing can be kept completely and it is effective for stable quality.

Figure 15:
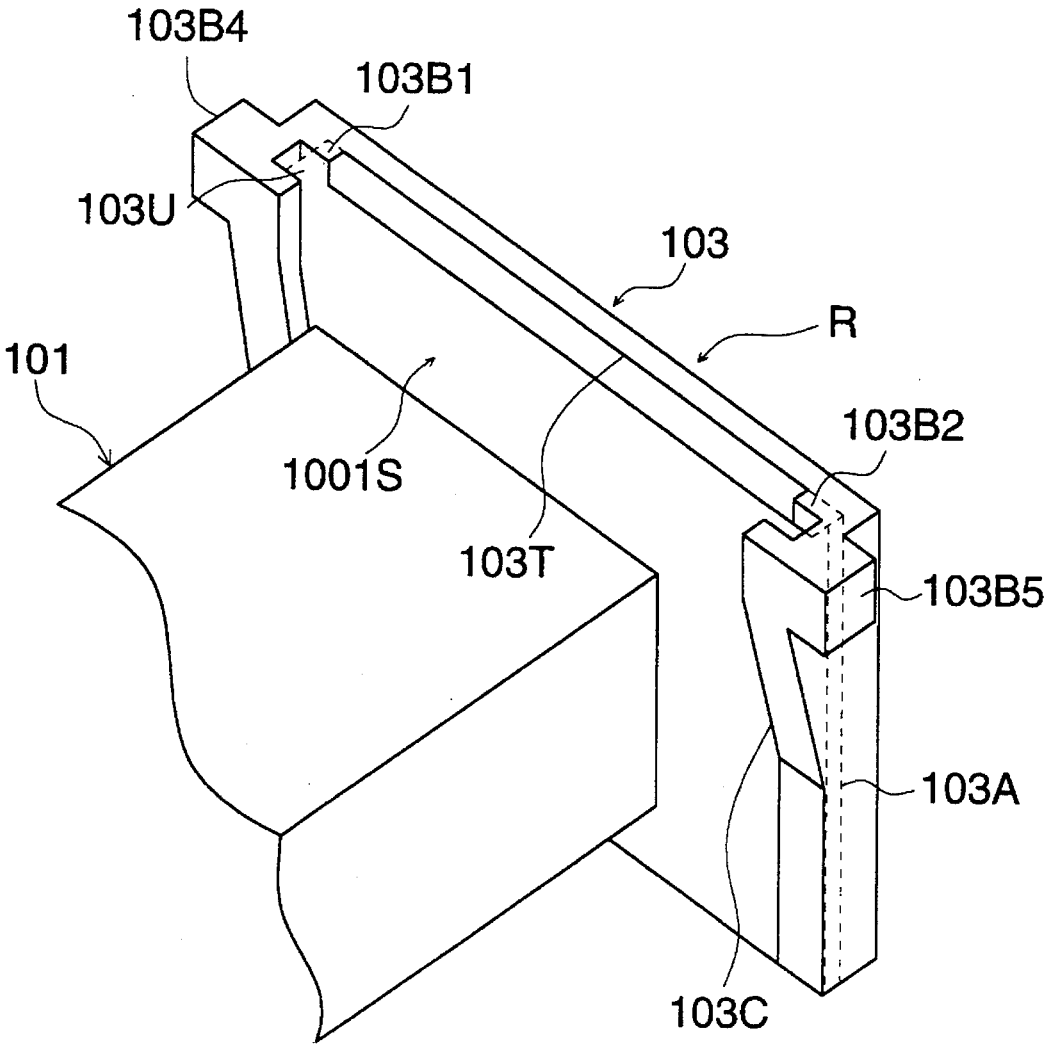
FIG. 15 is a perspective view of an accommodating container for processing agents for light-sensitive materials whose opening/closing cover is closed.
Figure 16:
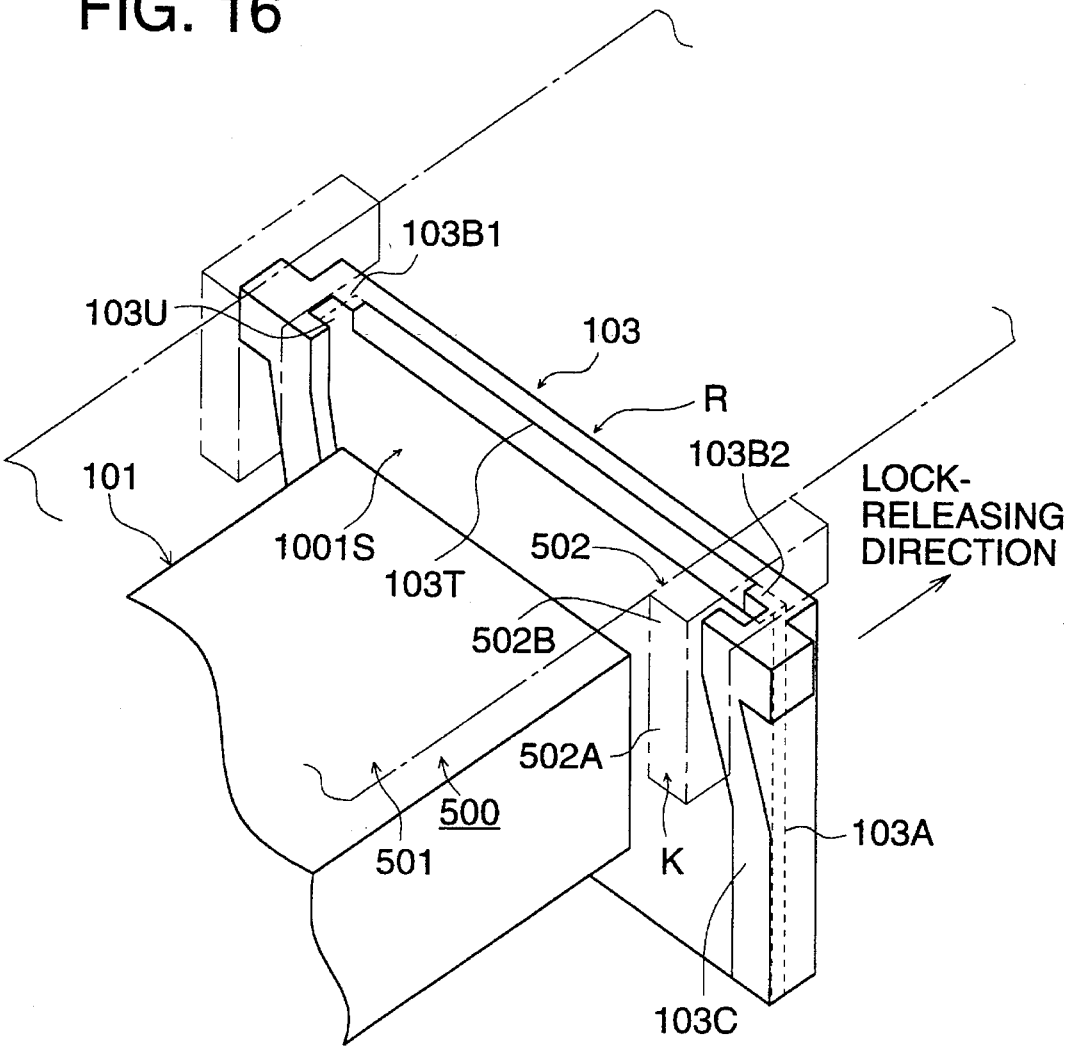
FIG. 16 is a perspective view of an accommodating container for processing agents for light-sensitive materials whose opening/closing cover is released from its locking.
Figure 17:
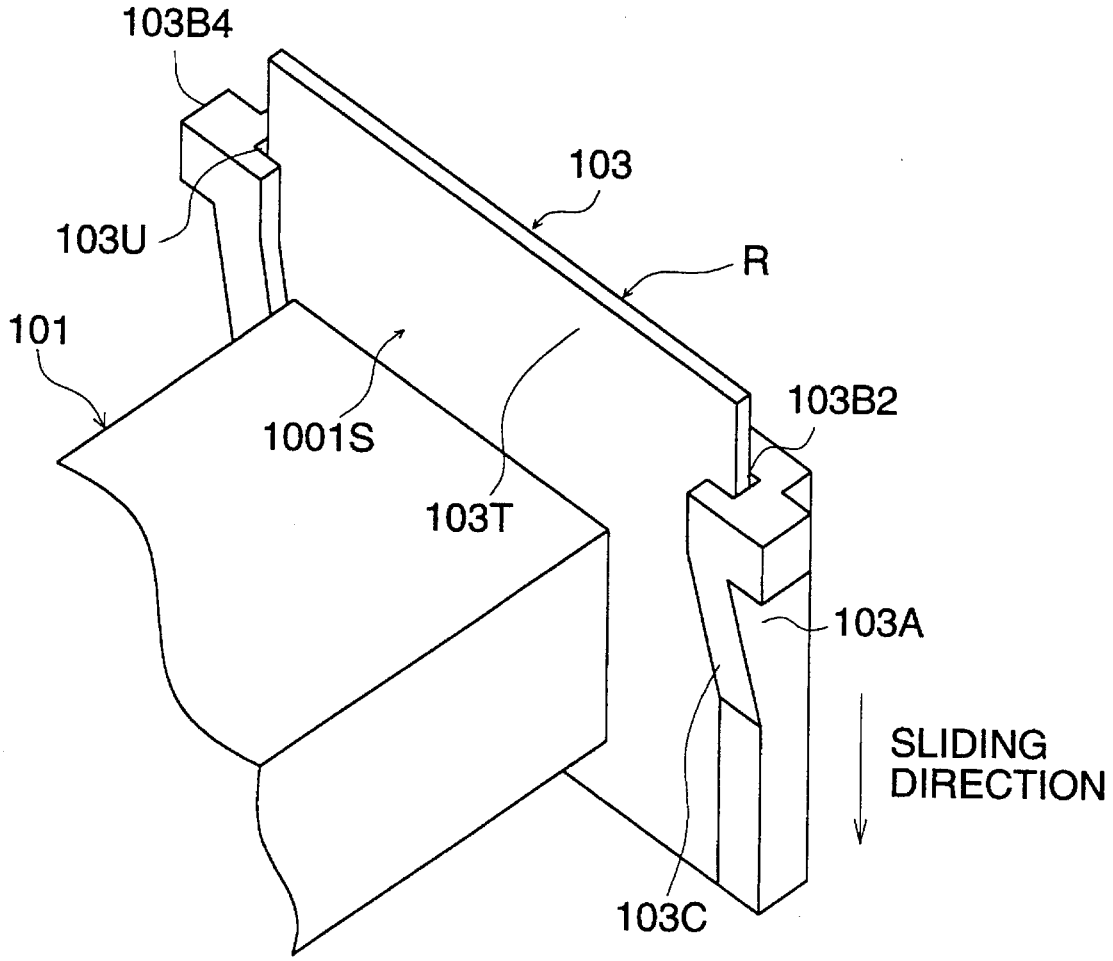
FIG. 17 is a perspective view of an accommodating container for processing agents for light-sensitive materials whose opening/closing cover is opened.

Next, structure of accommodating container 101 and opening/closing cover 103 both of accommodating container for processing agents for light-sensitive materials which attains the third object will be explained. FIG. 15 is a perspective view of closed opening/closing cover 103 of accommodating container for processing agents for light-sensitive materials 10, FIG. 16 is a perspective view of lock-released opening/closing cover 103 of accommodating container for processing agents for light-sensitive materials 10, and FIG. 17 is a perspective view of the state wherein opening/closing cover 103 of accommodating container for processing agents for light-sensitive materials 10 is opened.

On both outer sides of flange 1001S of accommodating container main body 101, there is formed rail portion 101R. On guide portion 103A of opening/closing cover 103, there is provided lock portion 103T which engages with flange 1001S of accommodating container 101 and guide groove 103U which enables flange 1001S to slide. The lock portion 103T is formed by protrusions 103B1, 103B2 and 103B3 formed on both sides of guide portion 103A in the slide direction, and the protrusions 103B1, 103B2 and 103B3 engage with flange 1001S so as to prevent opening/closing cover 103 from sliding to open. The opening/closing cover 103 is locked at the close position when the protrusions engage with flange 1001S, thus the structure for locking the opening/closing cover 103 is simple.

On guide portion 103A of opening/closing cover 103, there is formed inclined plane (a tapered section) 103C in the sliding direction. In the case of charging an accommodating container for processing agents for light-sensitive materials 10 in accommodating container charging section 501 of light-sensitive material processing apparatus 500, when sections 103B4, 103B5 touch follower 502A of pressing member 502 provided on accommodating container charging section 501, the inclined plane 103C of the opening/closing cover 103 is pushed and moved in the direction perpendicular to the sliding direction (lock-releasing direction), thereby flange 1001S of accommodating container main body 101 is released from the engagement with from the lock portion 103B1, 103B2 of the opening/closing cover 103 so that the opening/closing cover 103 can slide to open. The pressing member 502 provided on the accommodating container charging section 501 serves as lock-releasing means K.

When the accommodating container for processing agents for light-sensitive materials 10 is charged on the accommodating container charging section 501, the edge sections 103B4, 103B5 of guide portion 103A for the opening/closing cover 103 touche stopper portion 502B of the pressing member 502 on the lock-releasing means K, thereby the opening/closing cover 103 is pushed in the lock-releasing direction and moved in the sliding direction, thus opening 101F of accommodating container main body 101 is opened.

Lock-releasing for the opening/closing cover 103 is made when accommodating container for processing agents for light-sensitive materials 10 is charged in accommodating container charging section 501 of light-sensitive material processing apparatus 500, as stated above. Therefore, even when the accommodating container for processing agents for light-sensitive materials 10 is handled carelessly or it is dropped by erroneous handling of an operator, or even when those other than an operator, children for example, play around with it, the opening/closing cover 103 is not opened.

Further, its handling is easy because no special lock-releasing operation is required. Moreover, lock-releasing is carried out by only pushing and moving the opening/closing cover 103 in the direction perpendicular to the sliding direction, which makes the structure of lock-releasing to be simple and makes it easy to secure the space for mounting lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Protrusions 103B protruded at both lower ends of opening/closing cover 103 are used to close the opening/closing cover 103 automatically through engagement with an opening/closing control member for accommodating container charging section 501 of light-sensitive material processing apparatus 500.

Incidentally, in the case of accommodating container for processing agents for light-sensitive materials 10 as that in the present example, a clearance is generated between opening/closing cover 103 and accommodating container main body 101 due to weight of processing agents contained in the accommodating container 10. In the case of leakage before charging in the accommodating container charging section 501, it affects especially on a processing apparatus and naturally, it causes swelling of processing agents.

Figure 39:
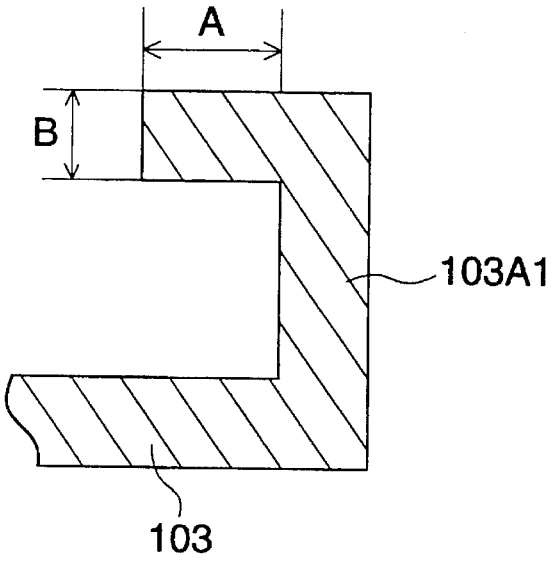
FIG. 39 is a sectional view of a protrusion of an opening/closing cover.

In order to solve this problem, therefore, protrusion 103A1 for engaging with flange 1001S of the accommodating container main body 101 is provided in addition to protrusion 103B1 formed on the lock portion of the opening/closing cover 103 as shown in FIGS. 37–40, so that the generation of the clearance can be prevented. FIG. 39 shows an enlarged diagram of the opening/closing cover 103. The length of the protrusion 103A1 is preferably 0.3 mm–1.0 mm, and it is preferable that the thickness of the protrusion B is 0.3 mm–1.5 mm because both bending and strength can be ensured.

Flange P formed on flange 1001S so that the thickness of the flange P changes to be thicker continuously in the direction from protrusion 103 B on one side to protrusion 13 B on the other side is for reducing leakage of contained processing agents through the clearance.

Figure 40:
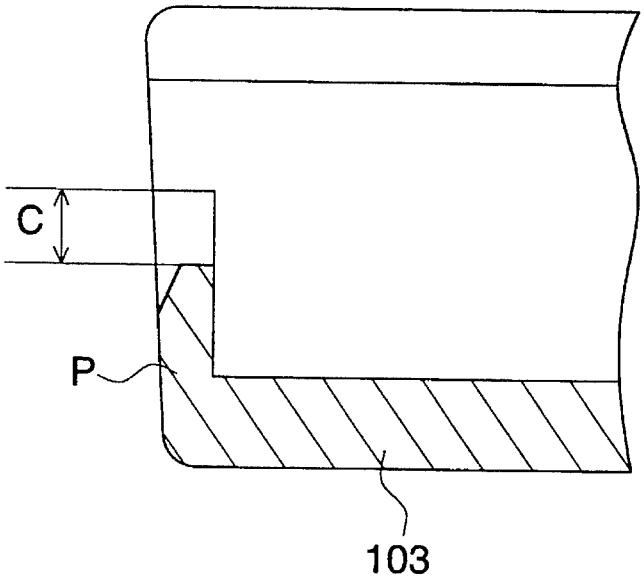
FIG. 40 is a sectional view of a flange of an opening/closing cover.

In this case, it is preferable that the thickness C at the center portion of the flange P is thinner than that in the vicinity of protrusion 103 B by 0.3 mm–1.0 mm as shown in FIG. 40 for opening and closing the opening/closing cover 103 smoothly.

Figure 18:
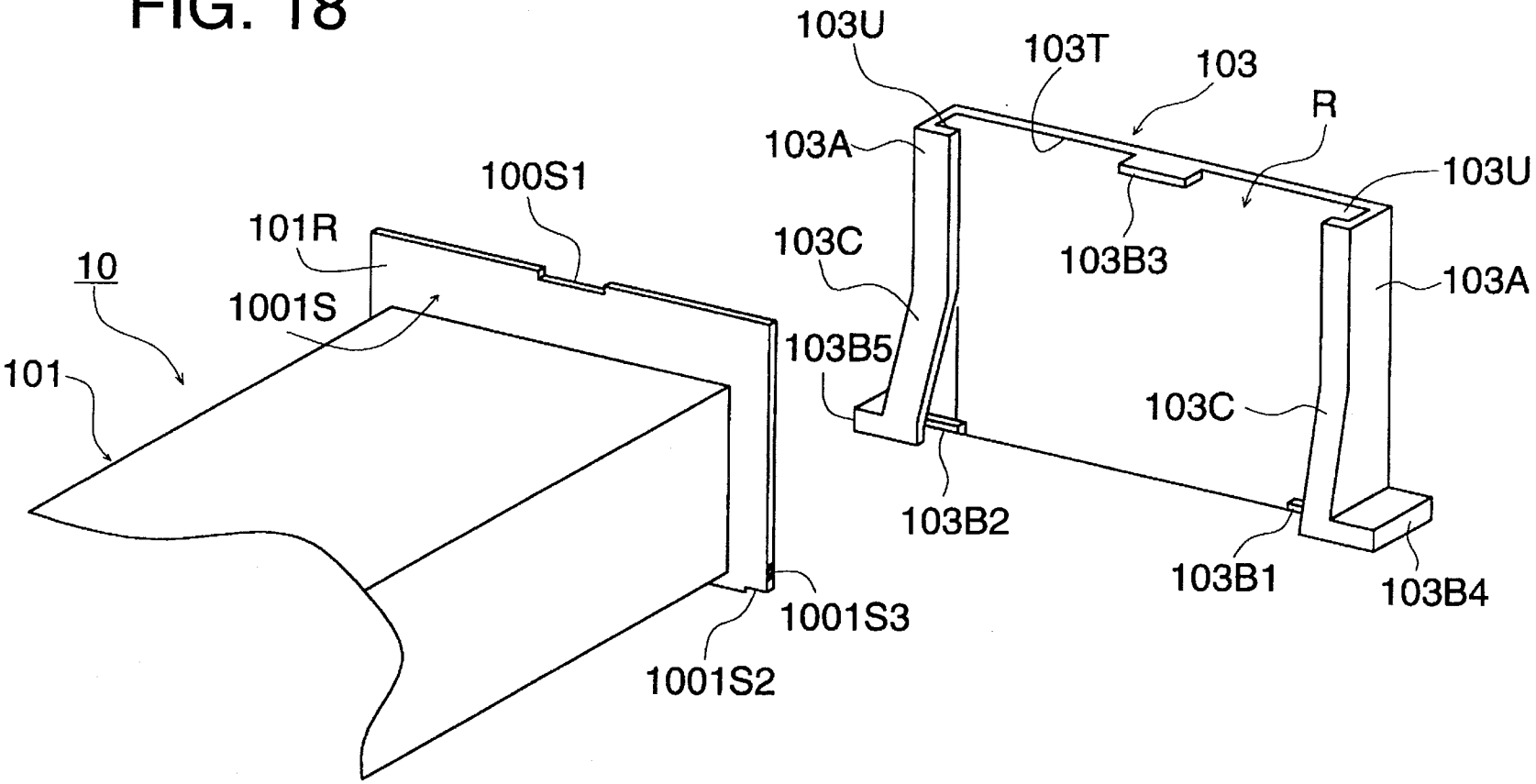
FIG. 18 is an exploded perspective view of an accommodating container for processing agents for light-sensitive materials.
Figure 19:
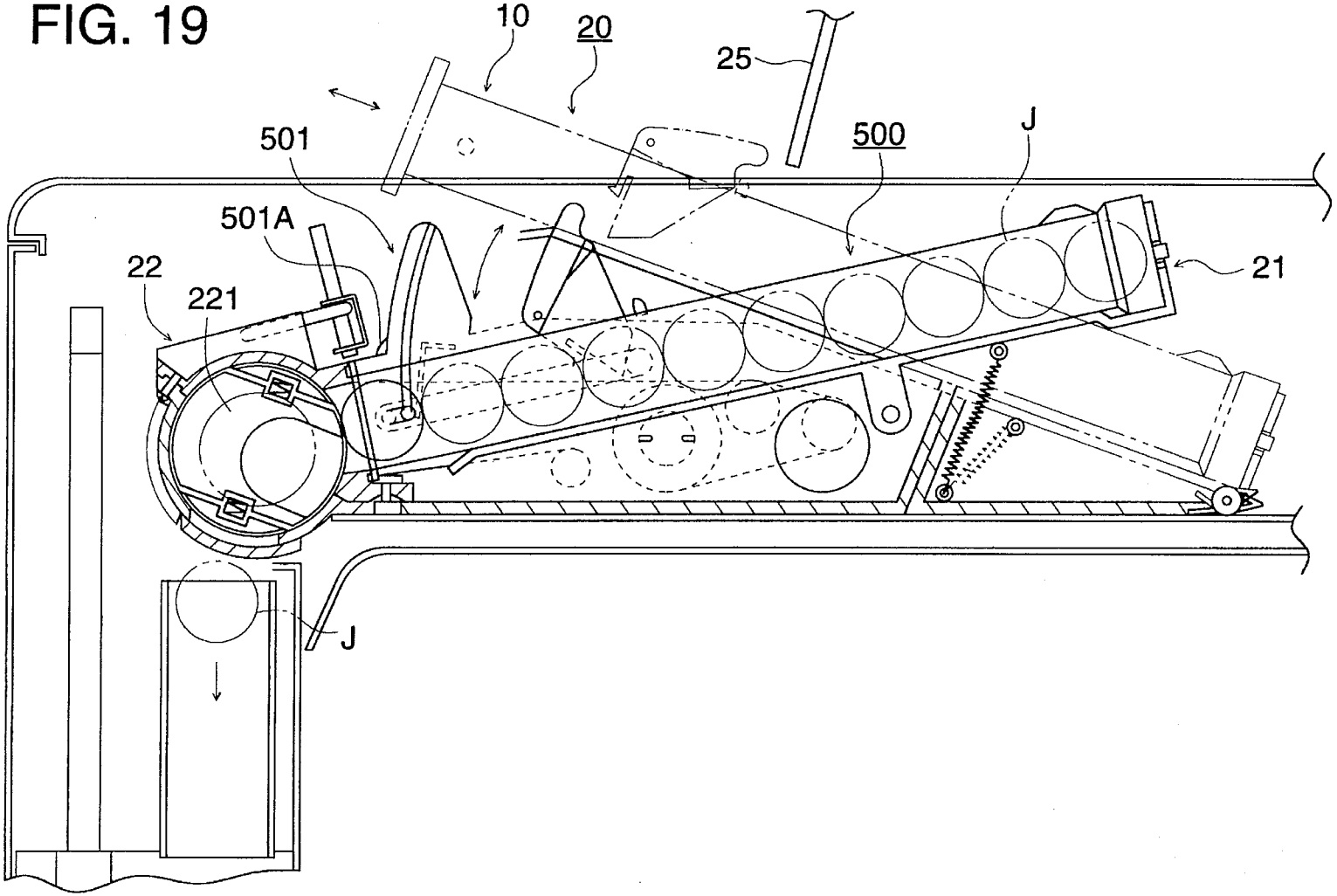
FIG. 19 is a perspective view showing how an accommodating container for processing agents for light-sensitive materials is charged in an accommodating container charging section of a light-sensitive material processing apparatus.
Figure 20:
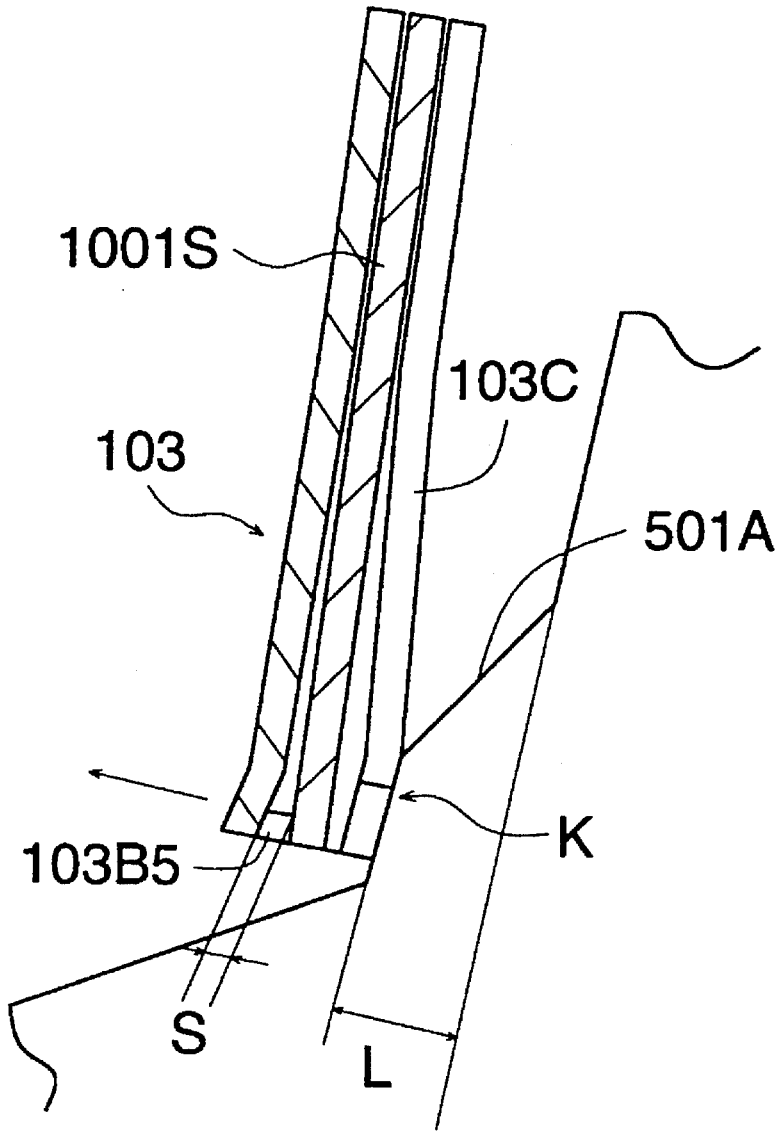
FIG. 20 is a sectional view showing how the lock of an opening/closing cover of an accommodating container for processing agents for light-sensitive materials is released.

FIGS. 18–20 show other examples of accommodating container for processing agents for light-sensitive materials 10 housing solid processing agent J of a tablet type in the invention, wherein FIG. 18 is an exploded perspective view of the accommodating container for processing agents for light-sensitive materials, FIG. 19 is a sectional view showing how the accommodating container for processing agent for light-sensitive materials 10 is charged in accommodating container charging section 501 of light-sensitive material processing apparatus 500, and FIG. 20 is a sectional view showing the lock-releasing for opening/closing cover 103 of the accommodating container for processing agents for light-sensitive materials 10.

On both external sides of flange 1001S of accommodating container main body 101 of the accommodating container for processing agents for light-sensitive materials 10, there are formed rail portions 101R. At the center portion on the top side of the flange 1001S, there is formed engagement cutout 1001S1, at the corner portions on both lower sides, there are formed engagement cutouts 1001S2, and on the side, there is formed protrusion 1001S3.

On guide portion 103A of opening/closing cover 103, there are provided lock portion 103T that engages with flange 1001S of accommodating container main body 101 and guide groove 103U that enables flange 1001S to slide. The lock portion 103T is formed by protrusion 103B3 formed at the upper center in the sliding direction of opening/closing cover 103 and by protrusions 103B4 and 103B5 formed on the both lower sides, and these protrusions 103B3, 103B4 and 103B5 engage with flange 1001S to hold it with pressure contact. Lock means R that controls sliding of opening/closing cover 103 is structured by the lock portion 103T, and the lock portion 103T engages with flange 1001S to close the opening/closing cover 103, which represents that the structure of locking the opening/closing cover 103 is simple.

The opening/closing cover 103 does not slide to open unless flange 1001S of accommodating container main body 101 gets over protrusions 103B3, 103B4 and 103B5 of lock portion 103T. In addition, even when flange 1001S of accommodating container 101 is in the state of moving from lock portion 103T to guide groove 101U, protrusion 1001S3 of flange 1001S is in contact with an inner side of guide portion 103A. Therefore, the frictional resistance between protrusion 1001S3 and guide portion 103A works as a load on sliding in its initial stage, and thereby the opening/closing cover 103 does not open even if the flange 1001S gets over protrusions 103B3, 103B4 and 103B5 of the lock portion 103T accidentally.

On guide portion 103A of opening/closing cover 103, there is formed inclined plane 103C in the sliding direction. In the case of charging accommodating container for processing agents for light-sensitive materials 10 in accommodating container charging section 501 of light-sensitive material processing apparatus 500, when the inclined plane 103C touches follower 501A provided on accommodating container charging section 501, the opening/closing cover 103 is bent and moved in the arrowed direction as shown in FIG. 20, and thereby flange 1001S of accommodating container main body 101 gets over protrusions 103B$ and 103B5 of lock portion 103T for opening/closing cover 103 to release locking for enabling the opening/closing cover 103 to slide. The follower 501A provided on accommodating container charging section 501 serves as lock-releasing means K.

When the accommodating container for processing agents for light-sensitive material 10 is further charged in accommodating container charging section 501, protrusion 103B of opening/closing cover 103 comes in contact with the follower 501A, and thereby the opening/closing cover 103 is pushed and moved in the sliding direction and opening 101F of accommodating container main body 101 is opened.

Lock-releasing for the opening/closing cover 103 is made when accommodating container for processing agents for light-sensitive materials 10 is charged in accommodating container charging section 501 of light-sensitive material processing apparatus 500, as stated above. Therefore, even when the accommodating container for processing agents for light-sensitive materials 10 is handled carelessly or it is dropped by erroneous handling of an operator, or even when those other than an operator, children for example, play around with it, the opening/closing cover 103 is not opened.

Further, its handling is easy because no special lock-releasing operation is required. Moreover, lock-releasing is carried out by only pushing and moving the opening/closing cover 103 in the direction perpendicular to the sliding direction, which makes the structure of lock-releasing to be simple and makes it easy to secure the space for mounting lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Figure 21:
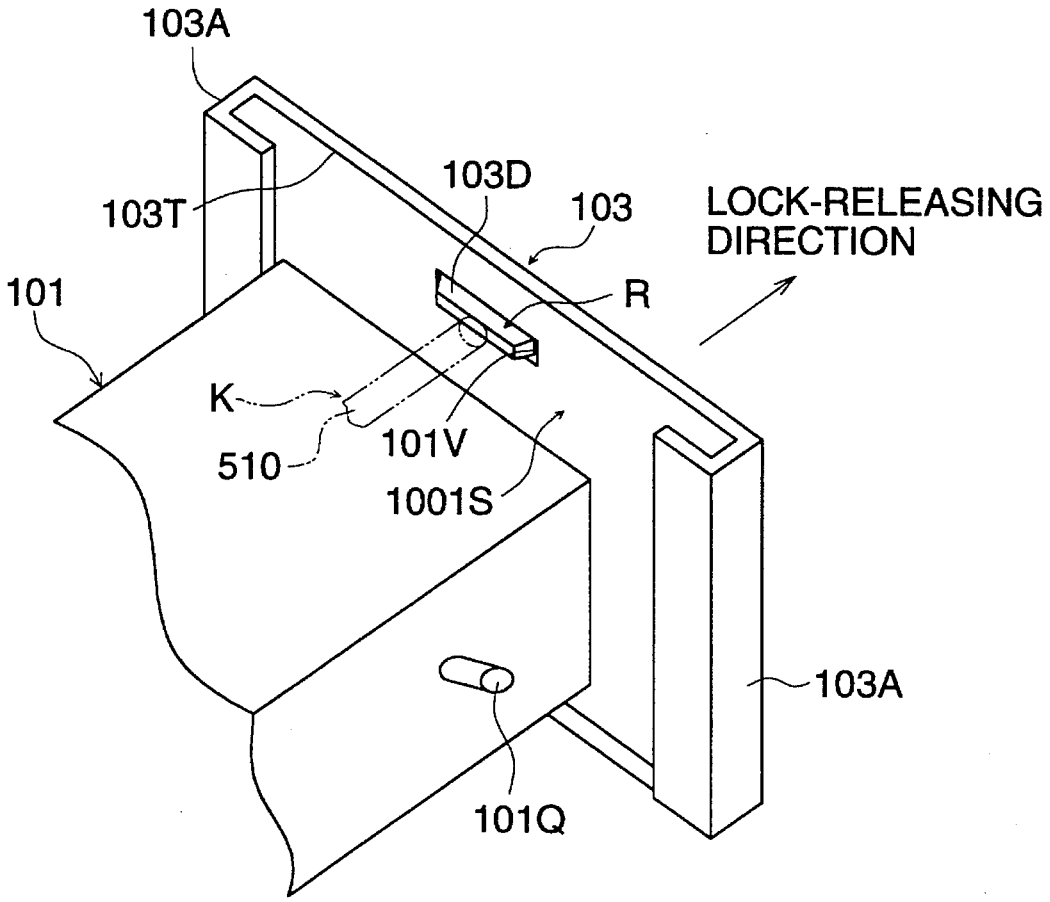
FIG. 21 is a perspective view of an accommodating container for processing agents for light-sensitive materials whose opening/closing cover is closed.
Figure 22:
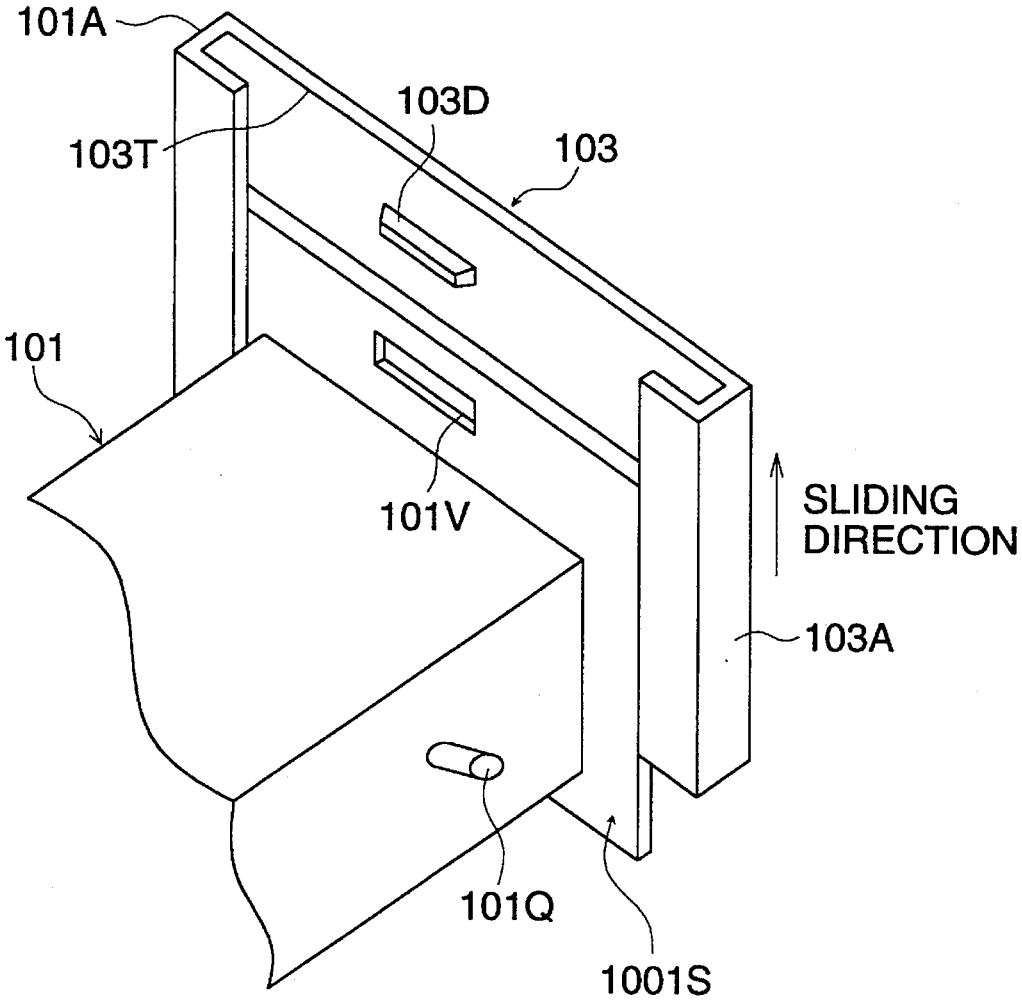
FIG. 22 is a perspective view of an accommodating container for processing agents for light-sensitive materials whose opening/closing cover is opened.

FIGS. 21–22 represent other examples of accommodating container for processing agents for light-sensitive materials 10 housing solid processing agent J of a tablet type in the invention, wherein FIG. 21 is a perspective view showing the state wherein opening/closing cover 103 of accommodating container for processing agents for light-sensitive materials is closed, while, FIG. 22 is perspective view showing the state wherein opening/closing cover 103 of accommodating container for processing agent for light-sensitive materials is opened.

On flange 1001S of accommodating container main body 101 of accommodating container for processing agents for light-sensitive materials 10, there is formed engagement hole 101V and this engagement hole 101V serves as an engagement portion of the accommodating container main body 101. On the opening/closing cover 103, there is formed protrusion 103D at the location facing the engagement hole 101V of flange 1001S, and this protrusion 103D serves as an engagement portion of the opening/closing cover 103. Engagement hole 101V provided on accommodating container main body 101 is caused to engage with the protrusion 103D of the opening/closing cover 103, and the opening/closing cover 103 is closed through such concave/convex engagement of the engagement portion, which represents that the structure for locking opening/closing cover 103 is simple.

When accommodating container for processing agents for light-sensitive materials 10 is charged in accommodating container charging section 501 of light-sensitive material processing apparatus 500 and thereby protrusion 103D of opening/closing cover 103 is pushed and moved in the direction perpendicular to the sliding direction by pressing and moving pin 510 provided on accommodating container charging section 501 through engagement hole 101V of flange 1001S, the opening/closing cover 103 is bent and protrusion 103D moves to come off the engagement hole 101V of flange 1001S, thus the locked concave/convex engagement is released to enable the opening/closing cover 103 to slide. This pressing and moving pin 510 serves as lock-releasing means K. The opening/closing cover 103 is pressed and moved in the sliding direction, and thereby opening 101F of accommodating container main body 101 is opened.

Lock-releasing for the opening/closing cover 103 is made when accommodating container for processing agents for light-sensitive materials 10 is charged in accommodating container charging section 501 of light-sensitive material processing apparatus 500, as stated above. Therefore, even when the accommodating container for processing agents for light-sensitive materials 10 is handled carelessly or it is dropped by erroneous handling of an operator, or even when those other than an operator, children for example, play around with it, the opening/closing cover 103 is not opened.

Further, lock-releasing is carried out by only pushing and moving the opening/closing cover 103 in the direction perpendicular to the sliding direction, which makes the structure of lock-releasing to be simple and makes it easy to ensure the space for mounting lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Figure 23:
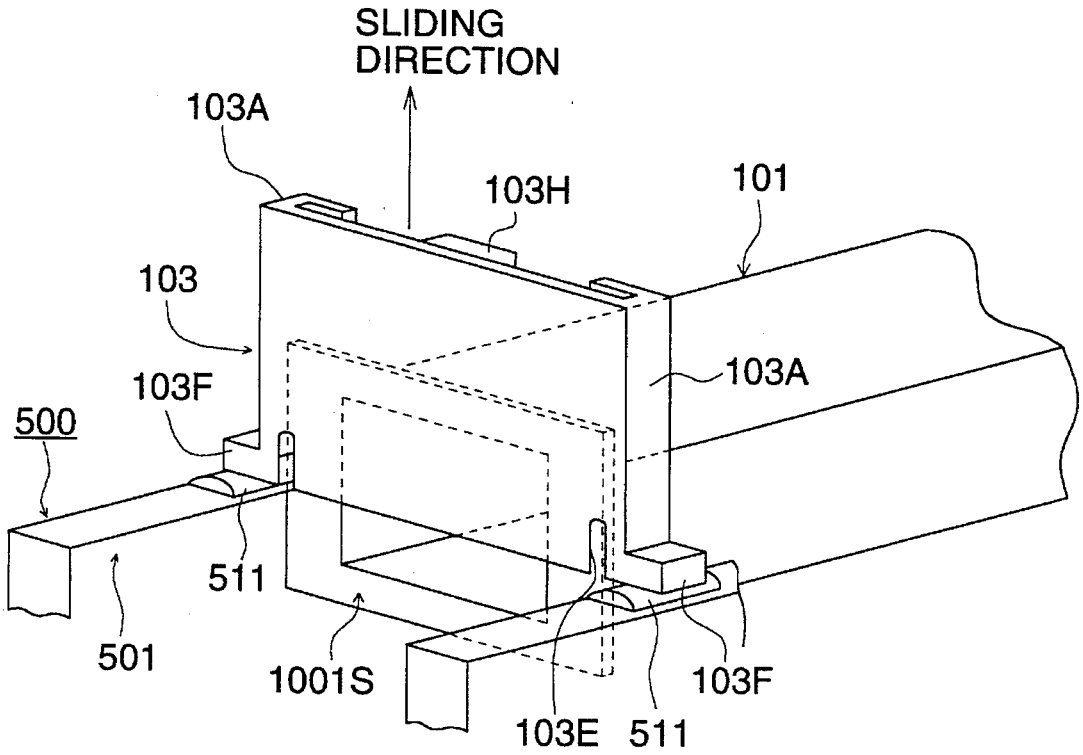
FIG. 23 is a perspective view of an accommodating container for processing agents for light-sensitive materials whose opening/closing cover is being opened.
Figure 24:
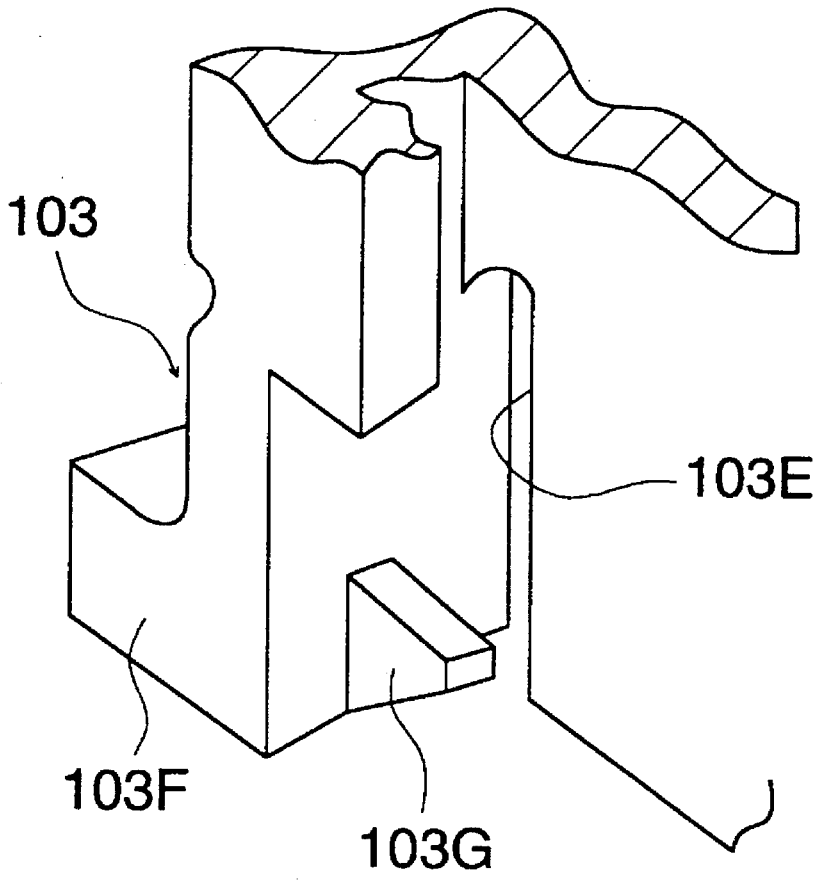
FIG. 24 is a partially enlarged perspective view of an opening/closing cover.
Figure 25:
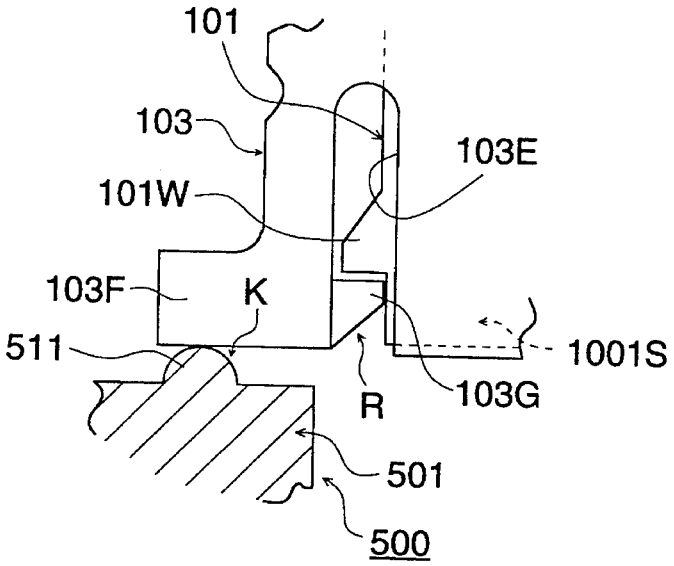
FIG. 25 is an enlarged sectional view showing the state wherein an opening/closing cover of an accommodating container for processing agents for light-sensitive materials is locked.
Figure 26:
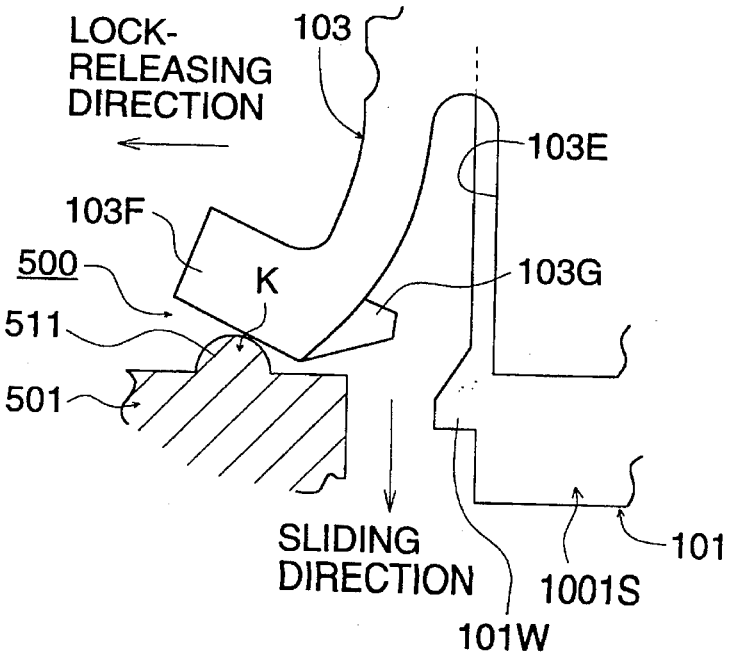
FIG. 26 is an enlarged sectional view showing the state wherein the lock of an opening/closing cover of an accommodating container for processing agents for light-sensitive materials is released.

FIGS. 23–26 represent other examples of accommodating container for processing agents for light-sensitive materials 10 housing solid processing agent J of a tablet type in the invention, wherein FIG. 23 is a perspective view showing how the opening/closing cover 103 of accommodating container for processing agents for light-sensitive materials is opened, FIG. 24 is a partially enlarged perspective view of an opening/closing cover, FIG. 25 is an enlarged side view of locked opening/closing cover 103 of accommodating container for processing agents for light-sensitive materials 10, and FIG. 26 is an enlarged side view showing the state wherein the opening/closing cover 103 of accommodating container for processing agents for light-sensitive materials is released from its locking.

On both sides of accommodating container 101 of accommodating container for processing agents for light-sensitive materials 10, there are formed protrusions 101 W on the back side of flange 1001S, and these protrusions 101W constitute an engagement portion of the accommodating container main body 101. On guide portion 103A of opening/closing cover 103, there is formed cutout portion 103E at the location facing each of the protrusions 101W of accommodating container main body 101, and bending portion 103F is provided. On the bending portion 103F, there is formed claw portion 103G, and the claw portion 103G constitutes an engagement portion of the opening/closing cover 103.

The claw portion 103G of the opening/closing cover 103 is caused to engage with protrusion 101W provided on accommodating container main body 101 to make an engagement portion to be a concave/convex engagement, and claw portion 103 H formed on the opening/closing cover 103 is further brought into contact with flange 1001S to close the opening/closing cover 103, which represents that the structure for locking the opening/closing cover 103 is simple.

When accommodating container for processing agents for light-sensitive materials 10 is charged in accommodating container charging section 501 of light-sensitive material processing apparatus 500, the opening/closing cover 103 is made to be capable of sliding through the process wherein bending portion 103F of the opening/closing cover 103 is pushed and moved to bend outside by protruded portion 511 that is provided on accommodating container charging section 501 and constitutes lock-releasing means K, claw portion 103G is disengaged from protrusion 101W of accommodating container main body 101, thus the concave/convex engagement is released from its locking.

When the accommodating container for processing agents for light-sensitive materials is further charged in the accommodating container charging section 501, the bending portion 103F is pushed and moved by protrusion 511 provided on the accommodating container charging section 501, thereby opening/closing cover 103 is pushed and moved in the sliding direction, and thereby opening 101F of accommodating container main body 101 is opened.

Lock-releasing for the opening/closing cover 103 is made when accommodating container for processing agents for light-sensitive materials 10 is charged in accommodating container charging section 501 of light-sensitive material processing apparatus 500, as stated above. Therefore, even when the accommodating container for processing agents for light-sensitive materials 10 is handled carelessly or it is dropped by erroneous handling of an operator, or even when those other than an operator, children for example, play around with it, the opening/closing cover 103 is not opened.

Since locking is released and opening/closing cover 103 is opened by only charging accommodating container for processing agents for light-sensitive materials 10, no special lock-releasing operation is required. Therefore, the structure is simple and handling is easy. In addition, lock-releasing can be carried out by only bending of bending portion 103F of opening/closing cover 103, which makes the structure of lock-releasing simple and makes it easy to ensure the installation space for lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Figure 27:
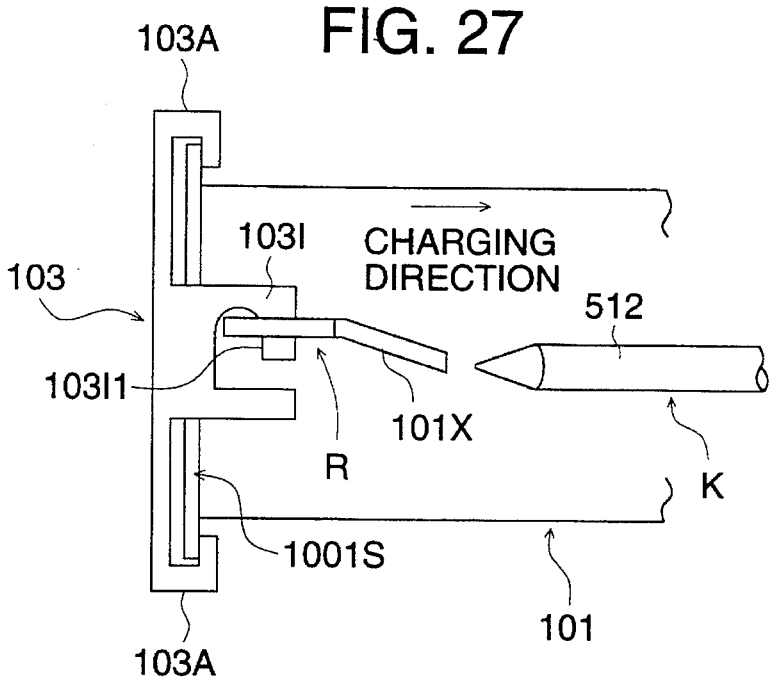
FIG. 27 is a plan view showing the state wherein an opening/closing cover of an accommodating container for processing agents for light-sensitive materials is closed.
Figure 28:
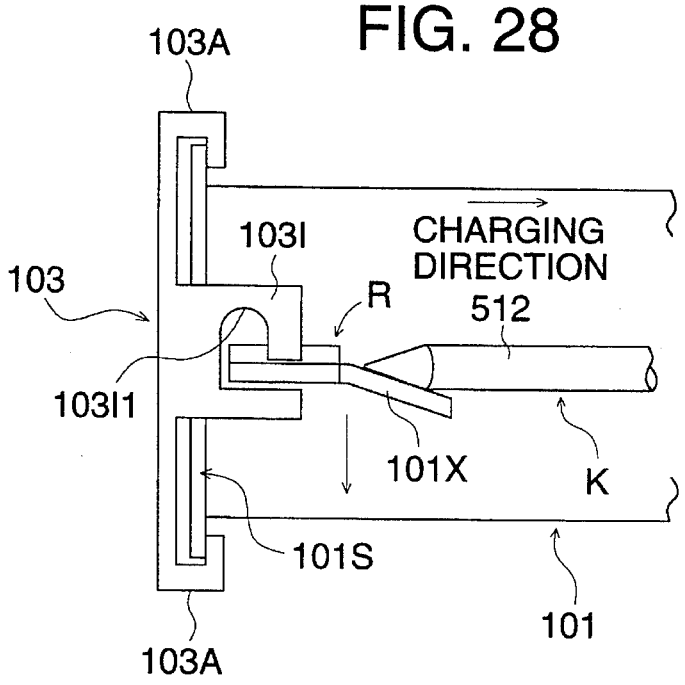
FIG. 28 is a plan view showing the state wherein an accommodating container for processing agents for light-sensitive materials is being charged.
Figure 29:
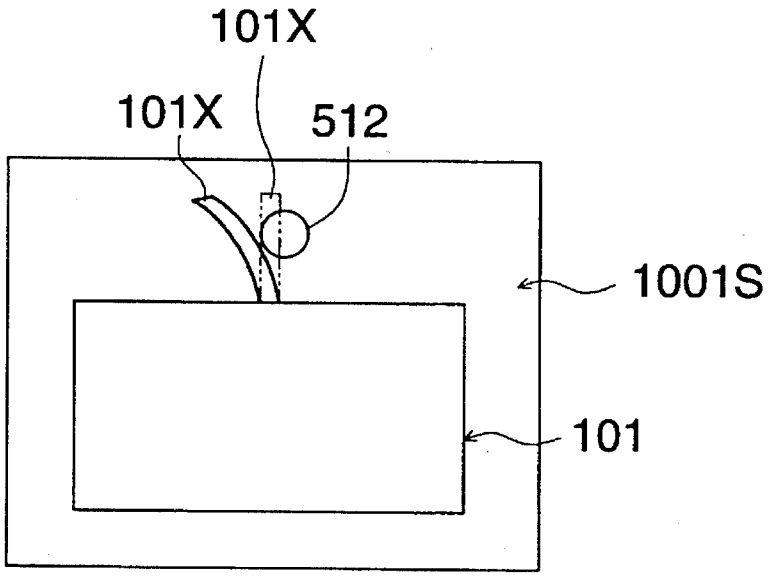
FIG. 29 is an illustration showing the state wherein the lock of an opening/closing cover of an accommodating container for processing agents for light-sensitive materials is being released.
Figure 30:
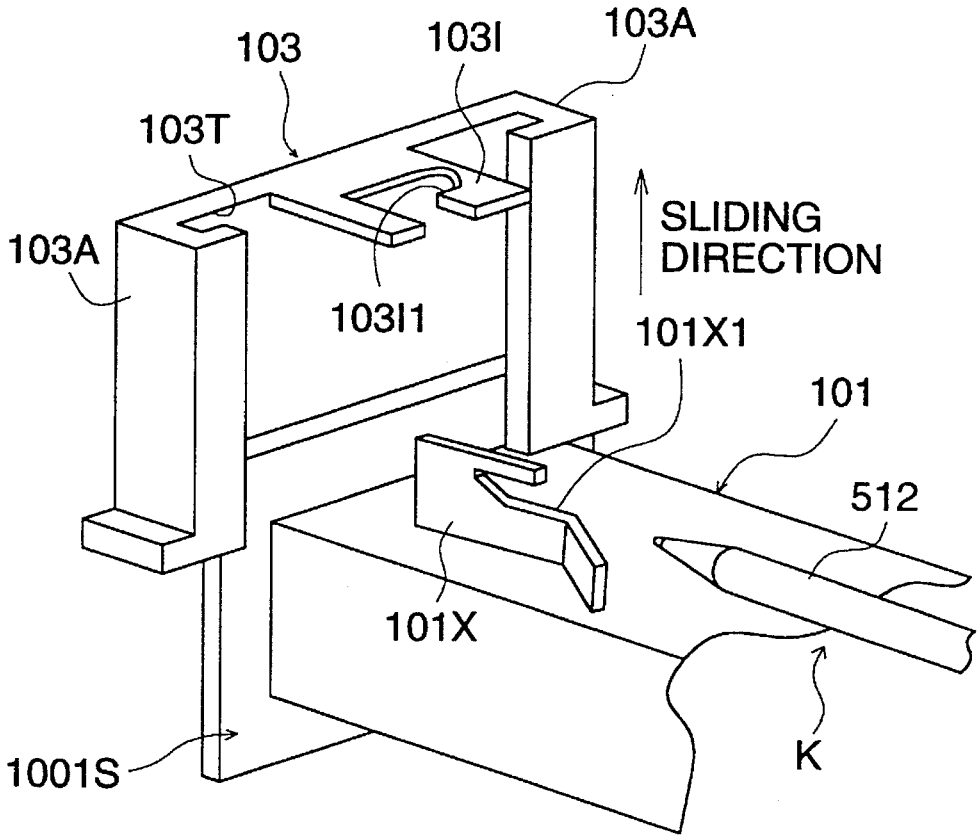
FIG. 30 is a side view showing the state wherein an opening/closing cover of an accommodating container for processing agents for light-sensitive materials is being opened.

FIGS. 27–30 represent other examples of accommodating container for processing agents for light-sensitive materials 10 housing solid processing agent J of a tablet type in the invention, wherein FIG. 27 is a plan view showing the state wherein opening/closing cover 103 of accommodating container for processing agents for light-sensitive materials 10 is charged, FIG. 29 is an illustration showing how the opening/closing cover 103 of accommodating container for processing agents for light-sensitive materials is released from its locking, and FIG. 30 is a side view showing how the opening/closing cover 103 of accommodating container for processing agents for light-sensitive materials is opened.

On the top side of accommodating container main body 101 of accommodating container for processing agents for light-sensitive materials, there is formed blade 101X having cutout 101X1 on the back side of flange 101S, and this blade 101X constitutes an engagement portion of the accommodating container main body 101. On the top of opening/closing cover 103, there is formed engagement piece 103I having cutout 103I1 at the location facing the blade 101X of the accommodating container main body 101, and this engagement piece 103I constitutes an engagement portion of the opening/closing cover 103.

The engagement piece 103I of opening/closing cover 103 is caused to engage with the blade 101X provided on accommodating container main body 101 to close the opening/closing cover 103 through concave/convex engagement of the engagement portion as stated above, thereby the structure for locking the opening/closing cover 103 is simple.

When accommodating container for processing agents for light-sensitive materials 10 is charged in accommodating container charging section 501 of light-sensitive material processing apparatus 500, blade 101X provided on accommodating container main body 101 is pressed by pressing pin 512 that is provided on the accommodating container charging section 501 and constitutes lock-releasing means K, and the blade 101X falls sideways. Thus, the blade 101X comes off engagement piece 103I of opening/closing cover 103 to release locking of concave/convex engagement for enabling the opening/closing cover 103 to slide. When the opening/closing cover 103 is pressed in the sliding direction, it moves and opening 101F of accommodating container main body 101 is opened.

Lock-releasing for the opening/closing cover 103 is made when accommodating container for processing agents for light-sensitive materials 10 is charged in accommodating container charging section 501 of light-sensitive material processing apparatus 500, as stated above. Therefore, even when the accommodating container for processing agents for light-sensitive materials 10 is handled carelessly or it is dropped by erroneous handling of an operator, or even when those other than an operator, children for example, play around with it, the opening/closing cover 103 is not opened.

Further, lock-releasing is carried out by only charging accommodating container for processing agent for light-sensitive materials 10 and no special lock-releasing operation is required. Therefore, the structure of lock-releasing is simple, and it is easy to ensure the space for mounting lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Figure 31:
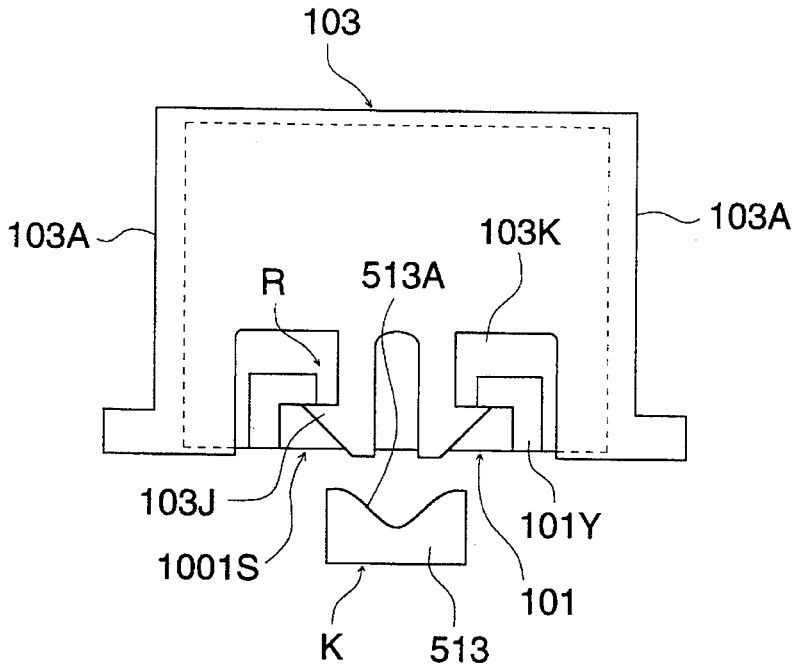
FIG. 31 is a front view showing the state wherein an opening/closing cover of an accommodating container for processing agents for light-sensitive materials is closed.
Figure 32:
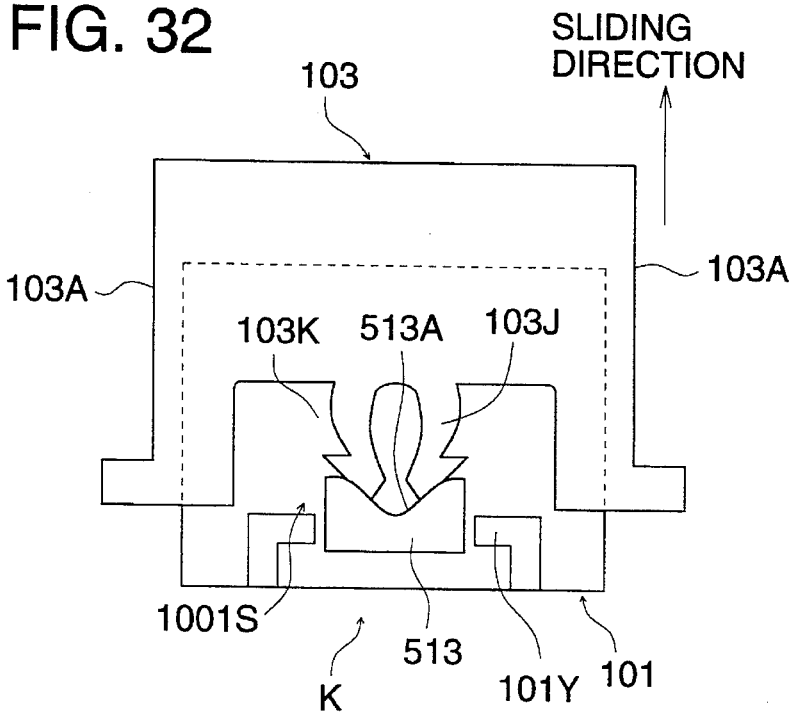
FIG. 32 is a front view showing the state wherein an accommodating container for processing agents for light-sensitive materials is being charged.
Figure 33:
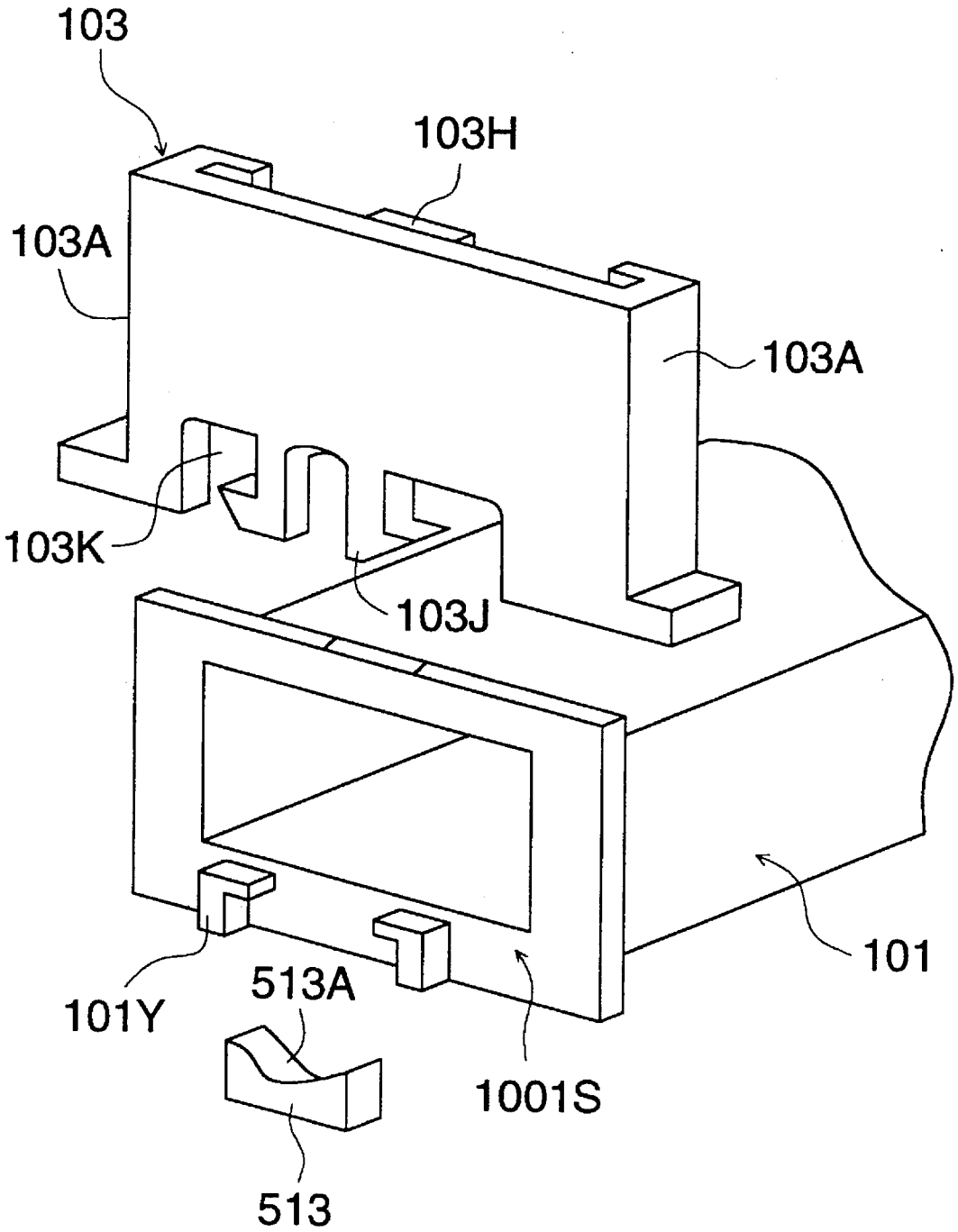
FIG. 33 is an exploded perspective view showing an accommodating container for processing agents for light-sensitive materials and a releasing piece.

FIGS. 31–33 represent other examples of accommodating container for processing agent for light-sensitive materials 10 housing solid processing agent J of a tablet type in the invention, wherein FIG. 31 is a front view showing the state wherein opening/closing cover 103 of accommodating container for processing agents for light-sensitive materials 10 is closed, FIG. 32 is a front view showing the accommodating container for processing agents for light-sensitive materials 10 is charged, and FIG. 33 is an exploded perspective view showing the accommodating container for processing agents for light-sensitive materials 10 and a releasing piece.

On the lower side of flange 1001S of accommodating container main body 101 of accommodating container for processing agents for light-sensitive materials 10, there is formed hook 101Y, and this hook 101Y constitutes an engagement portion of the accommodating container main body 101. On the lower portion of opening/closing cover 103, there is formed claw portion 103 J at the location facing the hook 101Y of the accommodating container main body 101, and this claw portion 103 J constitutes an engagement portion of the opening/closing cover 103. On both sides of the claw portion 103J, there are formed cutouts 103K with which the hook 101K engages.

The claw portion 103J of opening/closing cover 103 is caused to engage with the hook 101K provided on accommodating container main body 101 to close the opening/closing cover 103 through concave/convex engagement of the engagement portion, which represents that the structure for locking the opening/closing cover 103 is simple.

When accommodating container for processing agents for light-sensitive materials 10 is charged in accommodating container charging section 501 of light-sensitive material processing apparatus 500, claw portion 103J provided on accommodating container main body 101 is pressed by releasing piece 513 that is provided on accommodating container charging section 501 and constitutes lock-releasing means K. Since the contact surface of the releasing piece 513 is formed to be inclined portion 513A, claw portion 103J provided on the accommodating container main body 101 is bent inside and the claw portion 103J is disengaged from hook 101Y of the accommodating container main body 101, thus the concave/convex engagement is released from its locking, making the opening/closing cover 103 to be capable of sliding.

When the accommodating container for processing agents for light-sensitive materials 10 is further charged in the accommodating container charging section 501, claw portion 103J is pressed by the releasing piece 513 provided on the accommodating container charging section 501, thereby opening/closing cover 103 is pushed and moved in the sliding direction, thus opening 101F of accommodating container main body 101 is opened.

Lock-releasing for the opening/closing cover 103 is made when accommodating container for processing agents for light-sensitive materials 10 is charged in accommodating container charging section 501 of light-sensitive material processing apparatus 500, as stated above. Therefore, even when the accommodating container for processing agents for light-sensitive materials 10 is handled carelessly or it is dropped by erroneous handling of an operator, or even when those other than an operator, children for example, play around with it, the opening/closing cover 103 is not opened.

When accommodating container for processing agents for light-sensitive materials 10 is charged, claw portion 103J is pressed by releasing piece 513 constituting lock-releasing means K, and thereby opening/closing cover 103 is pushed and moved in the sliding direction and opening 101F of accommodating container main body 101 is opened. Therefore, no special lock-releasing operation is required and handling is easy. In addition, the structure of lock-releasing is simple and it is easy to ensure the space for installing lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Figure 34:
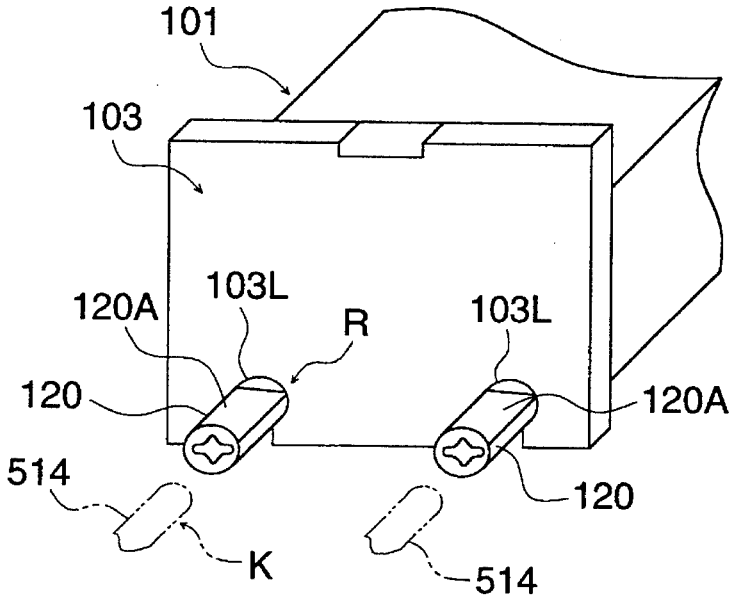
FIG. 34 is a perspective view show the state wherein an opening/closing cover of an accommodating container for processing agents for light-sensitive materials is closed.
Figure 35:
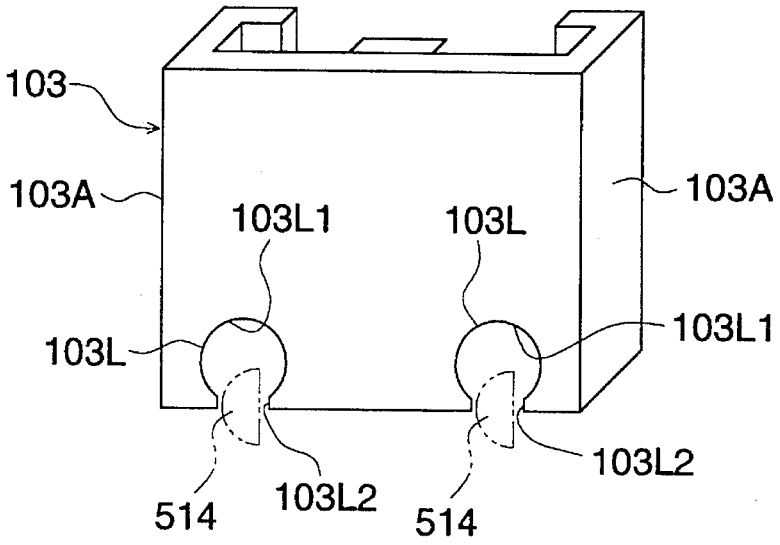
FIG. 35 is a perspective view of an accommodating container for processing agents for light-sensitive materials whose opening/closing cover is being opened.

FIGS. 34–35 represent other examples of accommodating container for processing agents for light-sensitive materials 10 housing solid processing agent J of a tablet type in the invention, wherein FIG. 34 is a perspective view showing the state wherein opening/closing cover 103 of the accommodating container for processing agents for light-sensitive materials 10 is closed and FIG. 35 is a perspective view showing how the opening/closing cover 103 of the accommodating container for processing agents for light-sensitive materials 10 is opened.

On the lower side of flange 1001S of accommodating container main body 101 of accommodating container for processing agents for light-sensitive materials 10, there are provided a pair of rotatable engaging pins 120, and a section of shaft portion 120A of each engaging pin 120 is formed to semicircular, and these engaging pins 120 constitute an engagement portion of the accommodating container main body 101. At the lower portion of opening/closing cover 103, there are formed engaging cutouts 103L at the locations facing the engaging pins 120 of the accommodating container main body 101, and each of the engaging cutouts 103L has circular portion 103L1 allowing the engaging pin 120 to rotate and path portion 103L2 allowing the engaging pin 120 to be mounted and dismounted, and these engaging cutouts 103S constitute an engagement portion of the opening/closing cover 103.

The engaging pin 120 provided on accommodating container main body 101 is inserted in circular portion 103L1 through the path portion 103L2 of the engaging cutout 103L on opening/closing cover 103, and the engaging pin 120 is rotated until it covers the path portion 103L2. Then, the engaging pin 120 is stopped for the concave/convex engagement of the engagement portion to close the opening/closing cover 103, which represents that the structure for locking the opening/closing cover 103 is simple.

When accommodating container for processing agents for light-sensitive materials 10 is charged in accommodating container charging section 501 of light-sensitive material processing apparatus 500, the engaging pin 120 is rotated by rotating member 514 that constitutes lock-releasing means K until the engaging pin 120 is positioned at the path portion 103L2 of engaging cutout 103L of opening/closing cover 103. Thus, the concave/convex engagement is released from its locking, making the opening/closing cover 103 to be capable of sliding.

Under the condition mentioned above, when the opening/closing cover 103 is pressed in the sliding direction, the engaging pin 120 is moved through the path portion 103L2 of the engaging cutout 103L, and opening 101F of accommodating container main body 101 is opened.

When the accommodating container for processing agents for light-sensitive materials 10 is further charged in the accommodating container charging section 501, claw portion 103J is pressed by the releasing piece 513 provided on the accommodating container charging section 501, thereby opening/closing cover 103 is pushed and moved in the sliding direction, thus opening 101F of accommodating container main body 101 is opened.

Further, lock-releasing is carried out by only rotating the engaging pin 120 with rotating member 514, and therefore, the structure of lock-releasing is simple and it is easy to ensure the space for installing lock-releasing means K.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Figure 36:
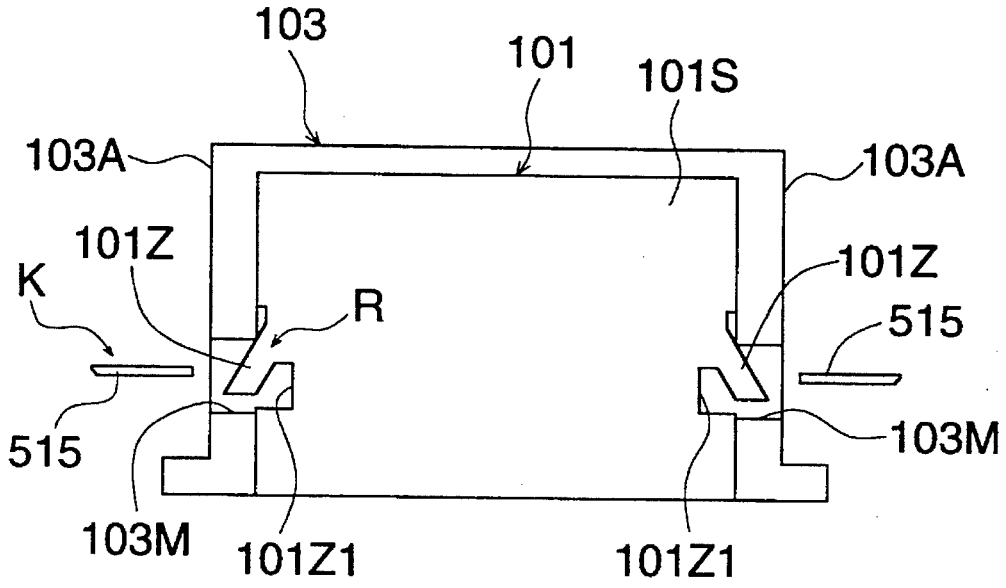
FIG. 36 is a front view showing the state wherein an opening/closing cover of an accommodating container for processing agents for light-sensitive materials is being opened.
Figure 37:
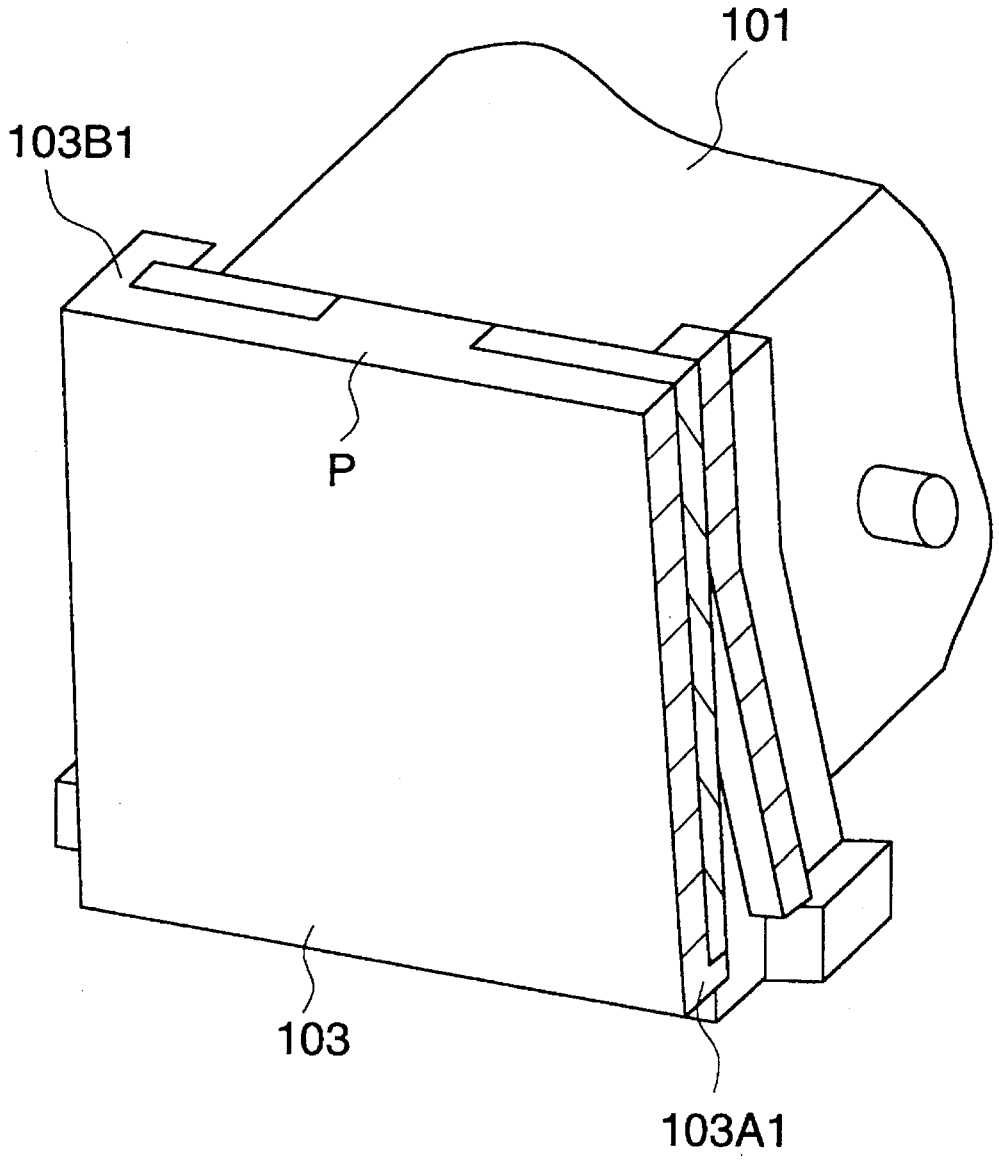
FIG. 37 is a perspective view wherein a part of an accommodating container for processing agents for light-sensitive materials shows its section.
Figure 38:
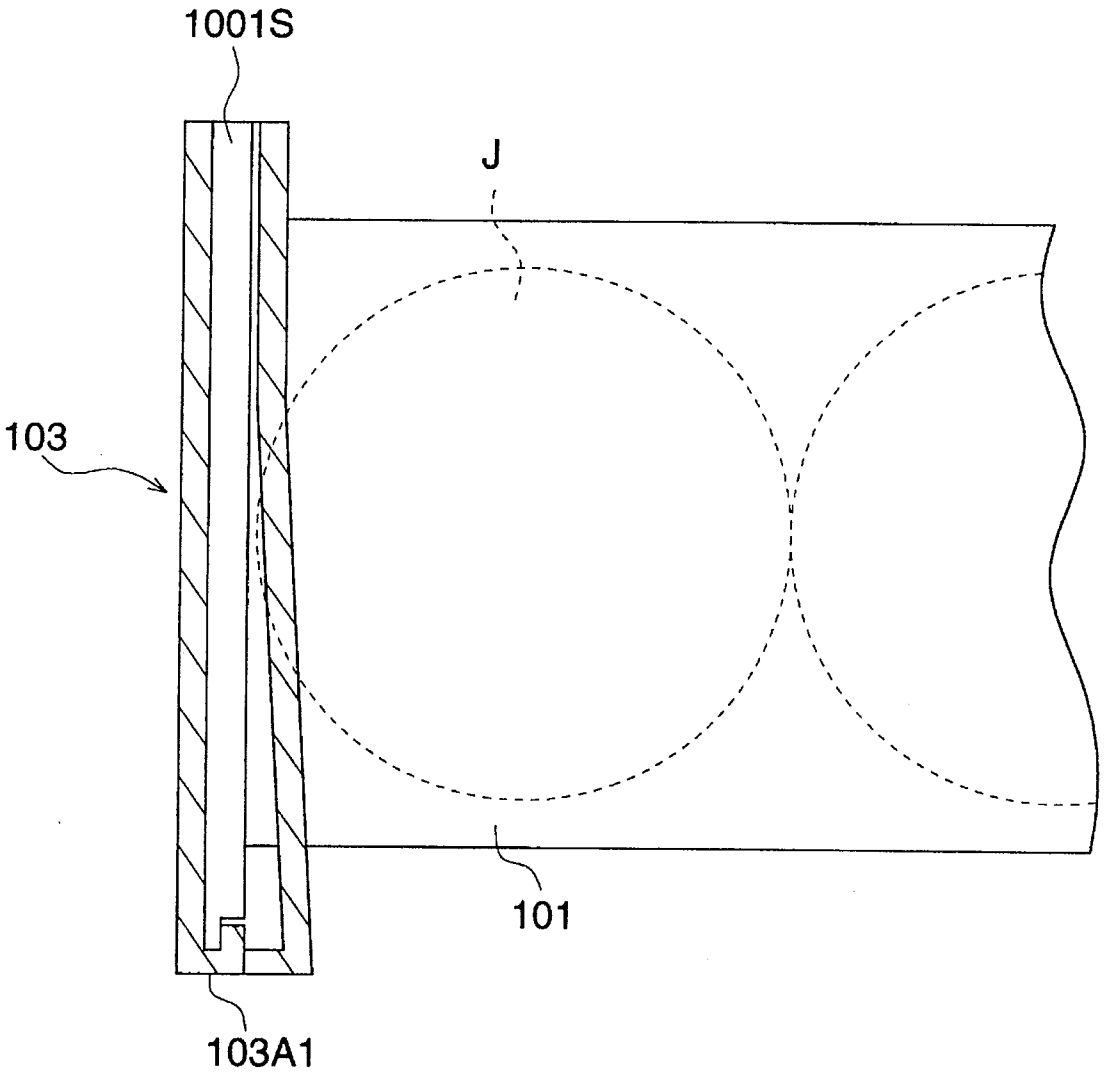
FIG. 38 is a side view wherein a part of an accommodating container for processing agents for light-sensitive materials shows its section.

FIG. 36 represents another example of accommodating container for processing agents for light-sensitive materials 10 housing solid processing agent J of a tablet type in the invention, wherein the figure is a front view showing how the opening/closing cover 103 of accommodating container for processing agents for light-sensitive materials 10 is opened.

On both sides of flange 1001S of accommodating container main body 101 of accommodating container for processing agents for light-sensitive materials 10, there are formed protruded claw portions 101Z and further cutouts 101Z1 which allow the claw portions 101Z to be bent, and these claw portions 101Z constitute an engagement portion of the accommodating container main body 101. On guide portions 103A of opening/closing cover 103, there are formed engaging cutouts 103M at the locations facing the claw portions 101Z of the accommodating container main body 101.

The claw portion 101Z provided on the accommodating container main body 101 is engaged with the engaging cutout 103M of the opening/closing cover 103 to close the opening/closing cover 103 through concave/convex engagement of an engagement portion, which represents that the structure for locking the opening/closing cover 103 is simple.

When accommodating container for processing agents for light-sensitive materials 10 is charged in accommodating container charging section 501 of light-sensitive material processing apparatus 500 and claw portion 101Z provided on accommodating container main body 101 is pressed by pressing pin 515 that constitutes lock-releasing means K through engaging cutout 103M of opening/closing cover 103, the claw portion 101Z is bent and is retreated to cutout 101Z1, and thereby the concave/convex engagement is released from its locking and the opening/closing cover 103 is made to be capable of sliding.

When the opening/closing cover 103 is pressed in the sliding direction under the condition mentioned above, it moves while sliding over the claw portion 101Z, and thereby opening 101F of accommodating container main body 101 is opened.

When the accommodating container for processing agents for light-sensitive materials 10 is further charged in the accommodating container charging section 501, claw portion 103J is pressed by the releasing piece 513 provided on the accommodating container charging section 501, thereby opening/closing cover 103 is pushed and moved in the sliding direction, thus opening 101F of accommodating container main body 101 is opened.

Further, when claw portion 101Z provided on container main body 101 is pressed by pressing pin 515 through engaging cutout 103M of opening/closing cover 103, the claw portion 101Z is bent and is retreated to cutout 101Z1 and thereby the opening/closing cover 103 is made to be capable of sliding, which represents that the structure of lock-releasing is simple and ensuring of the space for installing lock-releasing means K is easy.

It is further possible to make the installation space for an accommodating container charging section 501 to be extremely small. Therefore, it is possible to lessen moisture-containing air and thereby to provide an excellent system with less moisture-absorption to processing agents having moisture-absorbing property, although the accommodating container charging section 501 is in the state of high temperature and high humidity.

Incidentally, in each example mentioned above, guide groove 101U is provided by providing guide portion 103A on opening/closing cover 103. However, the guide groove may also be formed on flange 1001S of accommodating container main body 101 so that the opening/closing cover 103 can slide along the guide groove for opening and closing. In this case, locking means R and lock-releasing means K are structured in the same way.

As stated above, in the invention described in Example 2, locking can be released by charging an accommodating container for processing agents for light-sensitive materials in an accommodating container charging section of a light-sensitive material processing apparatus while controlling sliding of an opening/closing cover for the accommodating container for processing agents for light-sensitive materials. Therefore, even when the accommodating container for processing agents for light-sensitive materials is handled carelessly or it is dropped by erroneous handling of an operator, or even when those other than an operator, children for example, play around with it, the opening/closing cover is not opened.

In the invention described in Example 3, an opening/closing cover is closed when a lock portion of the opening/closing cover is engaged with a flange of an accommodating container main body, which represents that the structure for locking the opening/closing cover is simple. In addition, when an accommodating container for processing agents for light-sensitive materials is charged in an accommodating container charging section of a light-sensitive material processing apparatus, the opening/closing cover is pressed and a flange is moved from a lock portion to a guide groove for releasing locking. This represents that lock-releasing for the opening/closing cover is carried out by charging of the accommodating container for processing agents for light-sensitive materials. Therefore, accidental opening of the opening/closing cover can be prevented and no special lock-releasing operation is required, resulting in easy handling, simple structure of lock-releasing, and easy ensuring of installation space. It is further possible to make the installation space for an accommodating container charging section to be extremely small. Therefore, it is possible to lessen moisture-containing air and thereby to provide an excellent system with less moisture-absorption to processing agents having moisture-absorbing property, although the accommodating container charging section is in the state of high temperature and high humidity.

In the invention described in Example 2, an opening/closing cover is closed through concave/convex engagement between an engagement portion provided on the opening/closing cover and an engagement portion provided on an accommodating container main body, which represents that the structure for locking the opening/closing cover is simple. Further, when an accommodating container for processing agents for light-sensitive materials is charged, the engagement portion on the opening/closing cover or the engagement portion on the accommodating container main body is pressed to release concave/convex engagement, and thereby locking of the opening/closing cover is released. Therefore, accidental opening of the opening/closing cover can be prevented, the structure of lock-releasing is simple and ensuring of the installation space is easy. It is further possible to make the installation space for an accommodating container charging section to be extremely small. Therefore, it is possible to lessen moisture-containing air and thereby to provide an excellent system with less moisture-absorption to processing agents having moisture-absorbing property, although the accommodating container charging section is in the state of high temperature and high humidity.

In the invention described in Example 4, an opening/closing cover is closed through concave/convex engagement between an engagement portion provided on the opening/closing cover and an engagement portion provided on an accommodating container main body, which represents that the structure for locking the opening/closing cover is simple. Further, when an accommodating container for processing agents for light-sensitive materials is charged, the engagement portion on the opening/closing cover or the engagement portion on the accommodating container main body is pressed to release the concave/convex engagement, which represents that lock-releasing of the opening/closing cover is carried out by charging of the accommodating container for processing agents for light-sensitive materials. Therefore, accidental opening of the opening/closing cover can be prevented and no special lock-releasing operation is required, resulting in easy handling, simple structure of lock-releasing and easy ensuring of installation space. It is further possible to lessen moisture-containing air and thereby to provide an excellent system with less moisture-absorption to processing agents having moisture-absorbing property, although the accommodating container charging section is in the state of high temperature and high humidity.

What is claimed is:

1. An apparatus for supplying a solid processing agent having a predetermined size to a processing tank of a photographic material processing apparatus, comprising:

an accommodation container in which the solid processing agent is stored, the accommodation container having an outlet section provided with an outlet opening larger than the size of the solid processing agent so that the solid processing agent is enabled to be discharged through the outlet opening;

a container holder to hold the accommodation container, wherein the container holder is moved together with the accommodation container between at least two positions, on a first position of which the accommodation container is mounted on or dismounted from the container holder and on a second position of which the solid processing agent is discharged from the accommodation container;

a supply device having an inlet section to receive the solid processing agent from the outlet opening of the accommodation container arranged in the second position, and a supplying member to supply the solid processing agent to the processing tank;

urging means for applying an urging force to urge the accommodation container arranged in the second position toward the supply device so that the outlet section of the accommodation container is brought into contact with the inlet section of the supply device, to thereby discharge the solid processing agent to the inlet section;

releasing means for releasing the accommodation container from the urging force and for allowing the accommodation container to move toward the first position; and put-back means for putting the discharged solid processing agent back from the inlet section into the accommodation container when the accommodation container is moved from the second position to the first position.

2. The apparatus of claim 1, wherein the urging means is a spring which comes in contact with the accommodation container on the second position and pressing the accommodation container toward the supply device.

3. The apparatus of claim 2, wherein the releasing means is a handle member provided on the container holder.

4. The apparatus of claim 3, wherein the accommodation container is moved from the second position to the first position with the handle, the accommodation container is taken out of contact with the spring and is released from the urging force of the spring.

5. The apparatus of claim 1, wherein the put-back means is cooperative with the releasing means.

6. The apparatus of claim 1, wherein the put-back means is constructed by an arrangement of the accommodation container and the supply device when the accommodation container is moved from the second position to the first position.

7. The apparatus of claim 6, wherein, before the accommodation container is moved from the second position to the first position, the releasing means moves the accommodation container away from the supply device to a retracted position on the second position.

8. The apparatus of claim 5, wherein there is provided a distance (L) between the accommodation container and the supply device and wherein the solid processing agent is a disk-like tablet having a radius (r) and the distance (L) and the radius (r) satisfy a following relation:

$$L<r.$$

9. The apparatus of claim 1, wherein a handle member is mounted on the container holder and the accommodation container is inserted between the handle and the container holder.

10. The apparatus of claim 9, wherein the handle is provided with a groove at a specific position in accordance with a kind of a solid processing agent supplied to the processing tank and the accommodation container is provided with a protrusion on a specific position in accordance with a kind of a solid processing agent accommodated in the accommodation container, and wherein, when the kind of a solid processing agent in the accommodation container is different from that supplied to the processing tank, the groove of the handle allows the protrusion of the accommodation container to pass through when the accommodation container is inserted.

11. The apparatus of claim 9, wherein the handle is used as the releasing means.

12. The apparatus of claim 1, wherein the supply device and the accommodation container are shaped to come in contact with each other when the urging means urges the accommodation container toward the supply device.

13. The apparatus of claim 12, wherein the supply device is provided a packing member on a portion coming in contact with the accommodation container.

14. The apparatus of claim 1, wherein the accommodation container is provided a lid at a discharging opening thereof through which the solid processing agent is discharged from the accommodation container.

15. The apparatus of claim 1, wherein the lid is slidable on the discharging opening so as to open or close the discharging opening.

16. The apparatus of claim 15, further comprising an open/close device to open or close the lid interlockingly with the movement of the accommodation container between the first position and the second position.

17. The apparatus of claim 15, the accommodation container is provided with a locking device to lock the lid at the close position.

18. The apparatus of claim 1, wherein there is provided a distance (L) between the accommodation container, in a backwardly retracted condition, and the supply device, and wherein the solid processing agent is a disk-like tablet having a radius (r), and the distance (L) and the radius (r) satisfy the relation $L<r$.

* * * * *